US007658293B2

(12) United States Patent
Yamamoto et al.

(10) Patent No.: US 7,658,293 B2
(45) Date of Patent: Feb. 9, 2010

(54) INSTALLATION DEVICE FOR COUNTERWEIGHT

(75) Inventors: Kazunori Yamamoto, Obu (JP); Koji Yamagata, Kariya (JP); Yoshimasa Sugiura, Obu (JP)

(73) Assignee: Hitachi Sumitomo Heavy Industries Construction Crane Co., Ltd., Tokyo (JP)

( * ) Notice: Subject to any disclaimer, the term of this patent is extended or adjusted under 35 U.S.C. 154(b) by 23 days.

(21) Appl. No.: 12/062,145

(22) Filed: Apr. 3, 2008

(65) Prior Publication Data

US 2008/0253875 A1 Oct. 16, 2008

(30) Foreign Application Priority Data

Apr. 4, 2007 (JP) ..... 2007-098038

(51) Int. Cl.
*B66C 23/72* (2006.01)

(52) U.S. Cl. ..... 212/178; 212/195

(58) Field of Classification Search ..... 212/178, 212/195

See application file for complete search history.

(56) References Cited

U.S. PATENT DOCUMENTS

| | | | | | |
|---|---|---|---|---|---|
| 3,891,095 | A | * | 6/1975 | Symmank | 212/178 |
| 3,902,735 | A | | 9/1975 | Bertram et al. | |
| 4,141,455 | A | * | 2/1979 | Henderson et al. | 212/300 |
| 4,363,412 | A | * | 12/1982 | Patel et al. | 212/196 |
| 5,088,882 | A | | 2/1992 | Lovitt, Jr. | |
| 5,156,215 | A | * | 10/1992 | Jensen | 172/611 |
| 5,332,353 | A | | 7/1994 | Arnold | |
| 5,348,171 | A | * | 9/1994 | Haman et al. | 212/304 |
| 5,462,309 | A | | 10/1995 | Jeffers et al. | |
| 6,471,245 | B1 | | 10/2002 | Schott | |
| 6,533,319 | B1 | | 3/2003 | Denby et al. | |
| 6,988,560 | B2 | | 1/2006 | Bay | |
| 7,168,740 | B2 | | 1/2007 | Kobayashi et al. | |
| 2003/0222447 | A1 | | 12/2003 | Powell | |
| 2006/0103125 | A1 | | 5/2006 | Yamamoto | |

FOREIGN PATENT DOCUMENTS

| | | | |
|---|---|---|---|
| JP | 2-276979 | A | * 11/1990 |
| JP | 10-195927 | A | 7/1998 |
| JP | 11-200421 | A | 7/1999 |
| JP | 2000-72383 | A | 3/2000 |
| JP | 2002-194774 | A | 7/2002 |
| JP | 2006-44948 | A | 2/2006 |

* cited by examiner

*Primary Examiner*—Thomas J. Brahan
(74) *Attorney, Agent, or Firm*—Crowell & Moring LLP

(57) ABSTRACT

A counterweight installation device includes: a weight support unit provided on a rear end of a body frame of a construction machine; a weight mounting unit disposed on a counterweight; a pin member for mounting the counterweight adapted to move between a first position at which the weight mounting unit is mounted on the weight support unit and a second position at which the weight mounting unit is dismounted from the weight support unit; and a rod device, one end of which is linked with the pin member and an other end of which extends so as to project to an outside of the counterweight, adapted to move the pin member between the first position and the second position by operation at the other end thereof.

10 Claims, 21 Drawing Sheets

INSTALLATION DEVICE FOR COUNTERWEIGHT

INCORPORATION BY REFERENCE

The disclosure of the following priority application(s) is/are herein incorporated by reference:

Japanese Patent Application No. 2007-098038 filed Apr. 4, 2007.

The disclosure of the following application is herein incorporated by reference:

U.S. patent application Ser. No. 11/175,283.

BACKGROUND OF THE INVENTION

1. Field of the Invention

The present invention relates to an installation device for a counterweight with which the counterweight is mounted in a rear end of a body frame of a construction machine such as a crane.

2. Description of Related Art

Japanese Laid Open Patent Publication No. 2006-44948 discloses a counterweight device adapted to mount the counterweight in the rear end of the body frame. In this device, an upper part of a hydraulic cylinder integrally disposed to the counterweight is engaged with a body frame and the counterweight is lifted by drive of the hydraulic cylinder to mount the counterweight at a rear end of the body frame. On this occasion, after the counterweight is lifted by the drive of the hydraulic cylinder, a pin is inserted in an attaching portion of the counterweight in the horizontal direction to connect the counterweight to the body frame with the pin.

However, in order to allow the pin for mounting the counterweight to be inserted, it is necessary to secure a space for operation in a central portion of the counterweight, for example, by dividing the counterweight into right and left parts. This results in a loss of the weight of the counterweight.

SUMMARY OF THE INVENTION

A counterweight installation device according to a 1st aspect of the present invention includes: a weight support unit provided on a rear end of a body frame of a construction machine; a weight mounting unit disposed on a counterweight; a pin member for mounting the counterweight adapted to move between a first position at which the weight mounting unit is mounted on the weight support unit and a second position at which the weight mounting unit is dismounted from the weight support unit; and a rod device, one end of which is linked with the pin member and an other end of which extends so as to project to an outside of the counterweight, adapted to move the pin member between the first position and the second position by operation at the other end thereof.

According to a 2nd aspect of the present invention, it is preferable for the counterweight installation device according to the 1st aspect to further include: a hydraulic cylinder, integrally disposed with the counterweight, that raises and lowers the counterweight; and a recess that is formed at an upper surface of the counterweight on a rear side of the hydraulic cylinder to secure a space allowing the hydraulic cylinder or a peripheral part of the hydraulic cylinder to be operated from behind the counterweight.

According to a 3rd aspect of the present invention, in the counterweight installation device according to the 2nd aspect, it is preferable that the hydraulic cylinder includes a pair of hydraulic cylinders disposed along a direction of width of the body frame, and that the pin member is movable into a gap between the pair of hydraulic cylinders.

According to a 4th aspect of the present invention, in the counterweight installation device according to the 2nd aspect, it is preferable that the hydraulic cylinder is swingably supported on the counterweight in a direction of forward and rearward, and that a gripping part for operating the hydraulic cylinder is provided at a rear side of the hydraulic cylinder in correspondence with the recess.

According to a 5th aspect of the present invention, the counterweight installation device according to the 1st aspect may further include: an engaging groove disposed in the weight support unit; an engaging member disposed in the counterweight mounting unit; and a positioning device that regulates a position of the weight mounting unit relative to the weight support unit by engagement of the engaging groove with the engaging member.

According to a 6th aspect of the present invention, in the counterweight installation device according to the 1st aspect, it is preferable that the rod device includes a rod member linked to the pin member; and a rod operating member that operates the rod member.

According to a 7th aspect of the present invention, in the counterweight installation device according to the 6th aspect, the rod device may be configured such that the rod operating member extends and contracts relative to the rod member.

According to a 8th aspect of the present invention, in the counterweight installation device according to the 6th aspect, the rod device may be configured such that the rod operating member is foldable with respect to the rod member.

According to a 9th aspect of the present invention, in the counterweight installation device according to the 8th aspect, it is preferable that when the pin member is in the first position, the rod operating member is folded with respect to the rod member and when the pin member is in the second position, the rod operating member is disallowed to be folded with respect to the rod member.

According to a 10th aspect of the present invention, in the counterweight installation device according to the 8th aspect, it is preferable that a groove is formed in the rod member along a longitudinal direction thereof; and the rod device is constituted by inserting the rod operating member in the groove of the rod member, and linking the rod member with the rod operating member through a pin.

According to a 11th aspect of the present invention, in the counterweight installation device according to the 6th aspect, the counterweight may be provided with a concave part that extends in a direction of width of the body frame and through which the rod member passes, and a concave part that is provided on a side surface of the counterweight and that houses the rod operating member when the pin member is at the first position.

According to a 12th aspect of the present invention, in the counterweight installation device according to the 6th aspect, it is preferable that when the pin member is at the first position, the rod operating member functions as a retaining member for retaining the pin member.

According to a 13th aspect of the present invention, in the counterweight installation device according to the 10th aspect, the rod device may further include a ring pin that fixes the rod operating member to the rod member in a folded state.

DESCRIPTION OF PREFERRED EMBODIMENTS

First Embodiment

Figure 1:
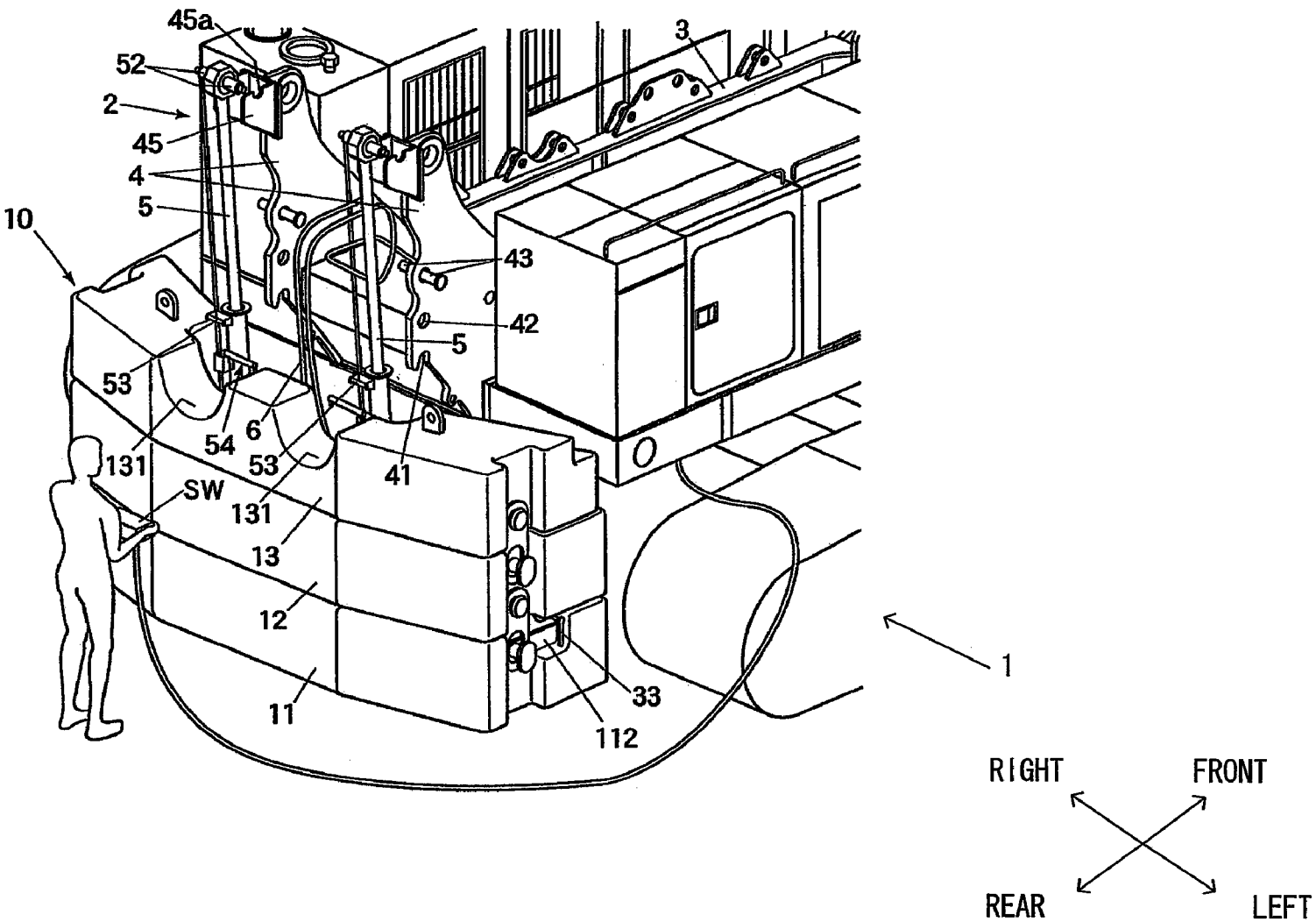
FIG. 1 is a perspective view illustrating an example of a counterweight mounting procedure executed with an installation device achieved in a first embodiment.

The following is an explanation of a first embodiment of a counterweight installation device according to the present invention given in reference to FIGS. 1 through 12. FIG. 1 is a perspective view showing an example of a counterweight installing procedure executed with the counterweight installation device achieved in the first embodiment. A counterweight 10 is installed in the rear end of a body of a construction machine in order to counteract a work moment chiefly due to a front work device installed at a front edge of the body of the construction machine. FIG. 1 shows an example of mounting the counterweight 10 that has three stages of weights in the direction of the top and bottom on a crane, which is a construction machine. Note that in the following, respective stages of the counterweight 10 are called a lower weight 11, a middle weight 12, and an upper weight 13. The total height of the counterweight 10 is, for instance, about 2 m.

The crane includes a traveling undercarriage 1 and a revolving superstructure 2 disposed rotatably to the traveling undercarriage 1. The revolving superstructure 2 includes a body frame 3 extending along the forward/rearward direction of the construction machine. At a front end of the body frame 3, there is provided a boom (not shown) as a front work device. The boom is supported on an axis so as to be raised and lowered. At the rear end of the body frame 3, there are disposed a pair of brackets 4, i.e., a right bracket and a left bracket, projecting behind and above the body frame 3.

Figure 2:
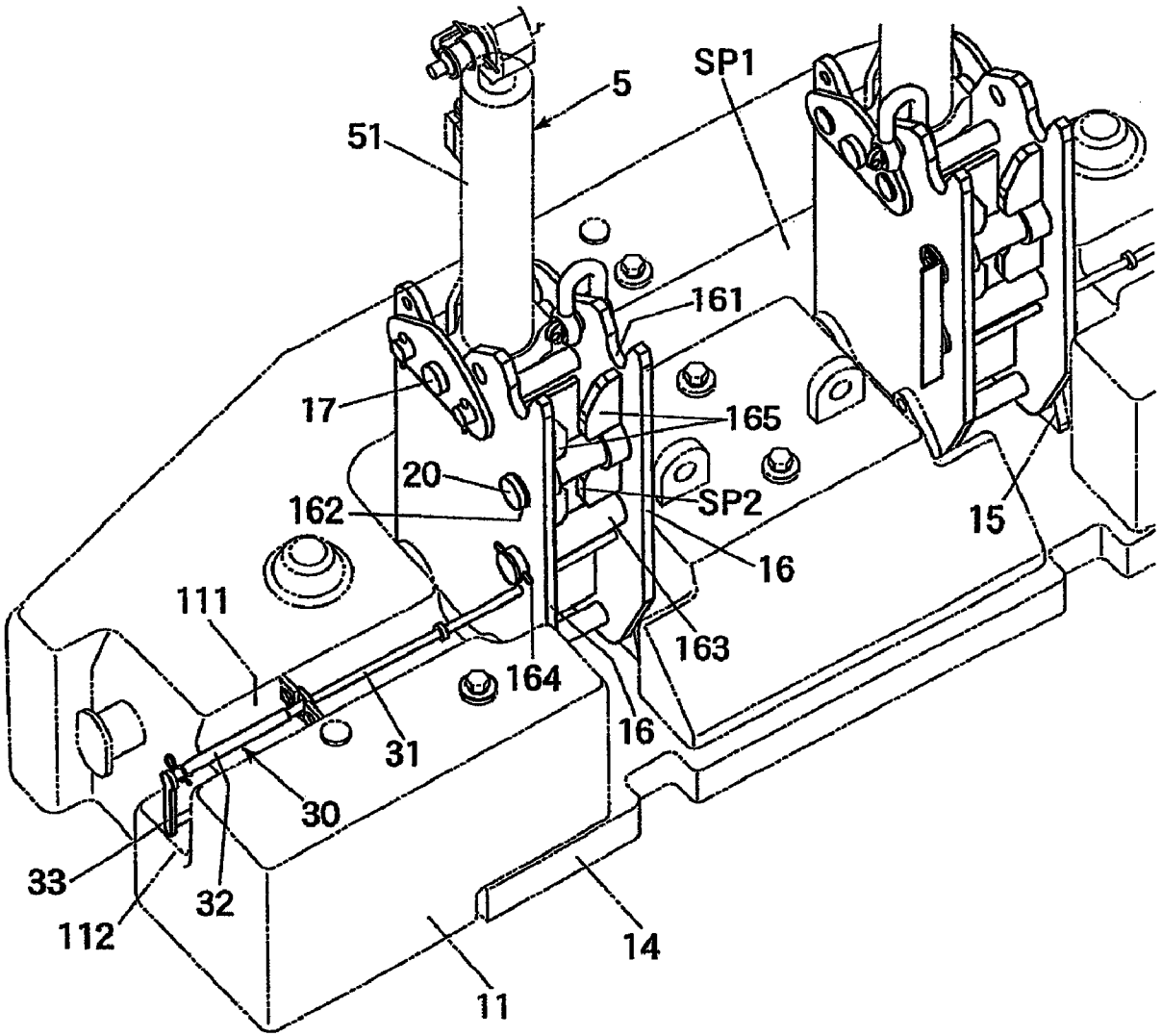
FIG. 2 is a perspective view of a counterweight in FIG. 1, viewed obliquely from the front thereof.

Respective weights 11 to 13 are formed substantially in a U-shape, as viewed from above (see FIG. 2). Therefore, a space SP1, which is surrounded by the weights 11 to 13, is formed in a front center part of the counterweight 10. In this space SP1 is set a pair of hydraulic cylinders 5 along the right and left direction relative to the crane. Each hydraulic cylinder 5 is driven by the pressure oil led from a hydraulic pump (not shown) installed in the revolving superstructure 2 through a hydraulic hose 6. The counterweight 10 is integrally constituted with the pair of hydraulic cylinders 5 and is raised and lowered by driving these hydraulic cylinders 5. The counterweight 10 lifted by driving the hydraulic cylinder 5 is supported on the brackets 4.

Figure 3:
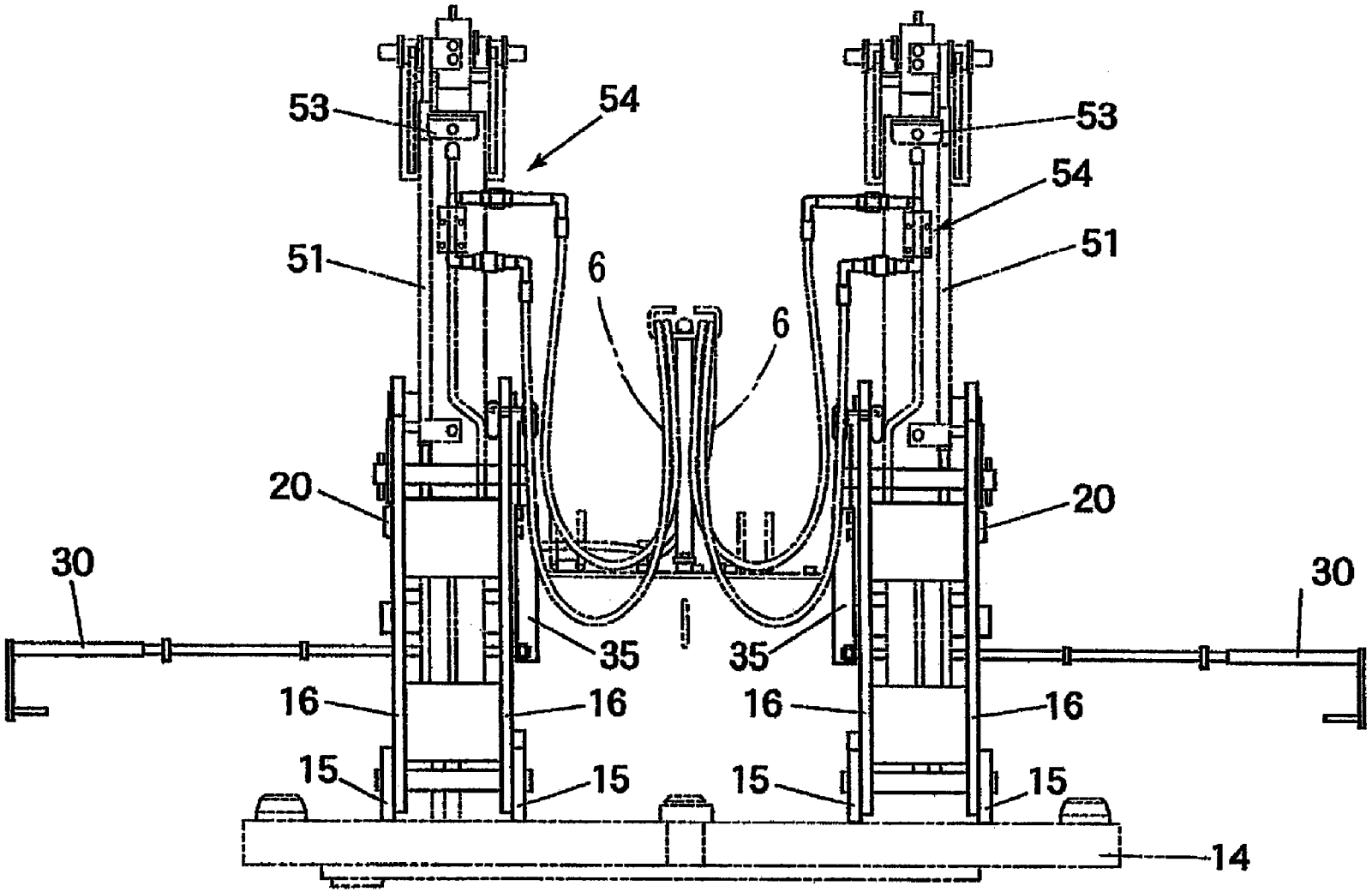
FIG. 3 is a perspective view of the counterweight in FIG. 1, viewed from the rearward.

FIG. 2 is a perspective view of the counterweight 10, viewed obliquely from the front thereof and FIG. 3 is a drawing of the counterweight 10, viewed from the rear thereof. Note that showing of the weights 12 and 13 is omitted in FIG. 2 and showing of the weights 11 to 13 is omitted in FIG. 3. Below the lower weight 11, there is provided a base weight 14 and the individual weights 11 to 14 are fastened together with links or bolts. On the upper surface of the base plate 14 at two positions along the right and left direction, there are set upright a pair of brackets 15, i.e., a right bracket and a left bracket.

As shown in FIG. 2, a support plate 16 is mounted on each bracket 15, and a cylinder tube 51 of the hydraulic cylinder 5 is supported by a pin 17 rotatably along the front and rear directions between the pair of support plates 16. On the upper surface of each support plate 16, there is formed a guide groove 161 substantially in a circular arc shape in front with respect to the hydraulic cylinder 5. The guide grooves 161 are each formed so as to taper from the entry area toward the innermost area thereof, and the width of the guide grooves 161 taken along the forward/rearward direction is the largest at the entry area.

Each support plate 16 is provided with a through hole 162 opening below the guide groove 161 and a support pin 20 is inserted in the through hole 162. Under the support pin 20, a guide pin 163 is set so as to penetrate through the support plate 16, On the leading edge of the guide pin 163 is mounted a retaining pin 164 to enable the guide pin 163 to be fixed to the pair of support plates 16 so that the guide pin 163 does not come off and fall. On inner side surfaces of the pair of support plates 16, there are provided guides 165 such that they project so as to face each other to define a gap SP2 therebetween, and the brackets 4 of the body frame 3 is to be inserted from above in the gap SP2.

As shown in FIG. 1, in the lower end of each bracket 4, there is formed a guide groove 41 substantially in a circular arc shape. The guide grooves 41 are each formed so as to taper from the entry area toward the innermost area, and the width of the guide grooves 41 taken along the forward/rearward direction is the largest at the entry area. In each bracket 4, a through hole 42 opens above the guide groove 41, and a guide pin 43, which projects horizontally along the right and left direction of the crane, is disposed on each side of the bracket 4 above the through hole 41. The guide groove 41, the through hole 42, and the guide pin 43 are disposed to the bracket 4 corresponding to the guide pin 163, the through holes 162, and the guide grooves 161 of the pair of support plates 16, and the pair of support plates 16 is held in position and mounted to the bracket 4 to be detailed later.

As shown in FIG. 1, a rod pin 52 is provided so as to project along the horizontal direction on the upper end of the cylinder rod of each hydraulic cylinder 5. A pair of support brackets 45 for supporting the rod pin 52 is disposed to the top end of each bracket 4. On the upper surface of each bracket 45, there is formed a concave part 45*a* further rearward of the rear end of the body frame 3 corresponding to the rod pin 52, and the rod pin 52 engages with the concave parts 45*a* of the pair of support brackets 45.

A handgrip 53 is attached to the rear surface of the cylinder tube 51 as shown in FIGS. 1 and 3. The handgrip 53 is used to swing the hydraulic cylinder 5, and when the operator draws the handgrip toward him or her, the hydraulic cylinder 5 can be rocked backward, and when the operator pushes the handgrip 53 into the depth, that is, forward, the hydraulic cylinder 5 can be rocked forward. A pair of concave parts 131 (recesses) are disposed toward the lower side substantially in an circular arc shape on the upper weight 13 corresponding to the position of the handgrip 53 disposed in the pair of hydraulic cylinders 5, respectively. As a result, the operator can operate the handgrip 53 by inserting his or her hands through the concave parts 131, respectively.

In addition, joints 54 for the hydraulic piping are disposed behind the cylinder tubes 51. The hydraulic hoses 6 in a bundled state as shown in FIG. 1 are guided from the front to between the pair of brackets 4 and then distributed rightward and leftward as shown in FIG. 3 to be connected with the respective joints 54. Since the joints 54 are disposed near the handgrips 53, the operator can mount or dismount hydraulic hoses 6 to the joints 54 by inserting his or her hands through the concave parts 131 of the upper surface of the upper weight 13.

A groove 111 is formed in the upper surface of the lower weight 11 along the right and left direction as shown in FIG. 2, and the rod 30 is housed in the groove 111 so as not to interfere with the middle weight 12. Note that while FIG. 2 shows only the groove 111 and the rod 30 disposed on a left side area of the lower weight 11, the groove 111 and the rod 30 are similarly disposed to a right area of the lower weight 11. As shown in FIG. 3, one end of each rod 30 is linked to the part of link 35 and the edge of support pin 20 is linked to the other end part of link 35. The rod 30 is slidably supported in the groove 111 along the right and left direction, and the support pin 20 can be inserted in and removed from the through hole 162 through the link 35.

Figure 4A:
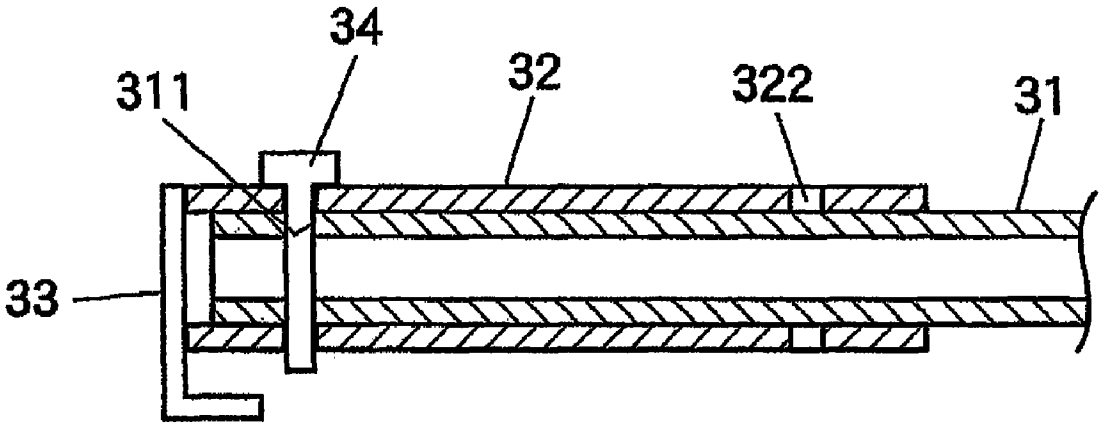
FIGS. 4A and 4B are each a cross-sectional view of a rod constituting the counterweight installation device according to the first embodiment.
Figure 4B:
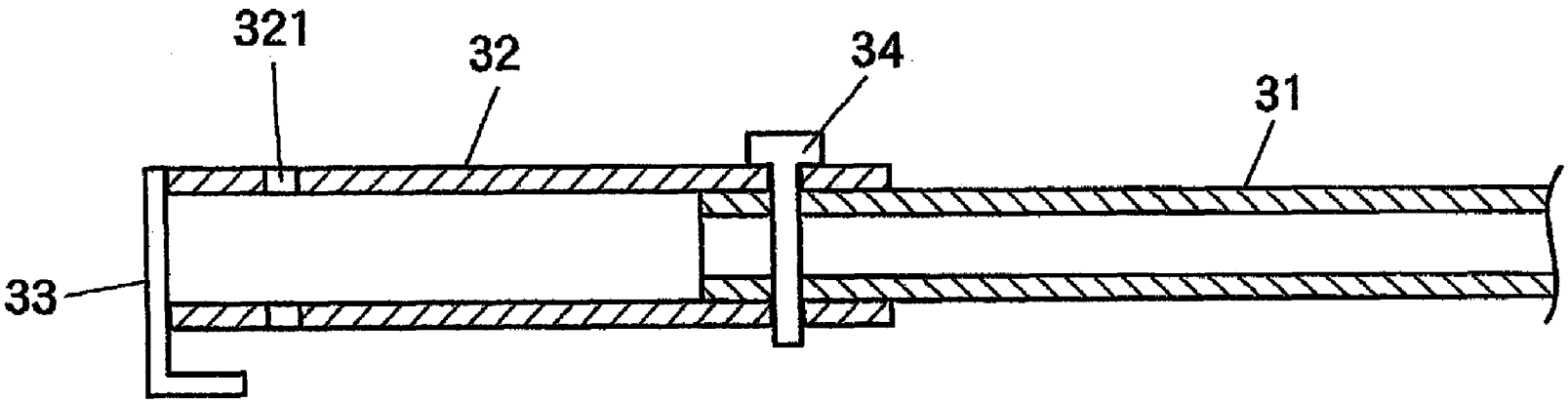
Figure 5:
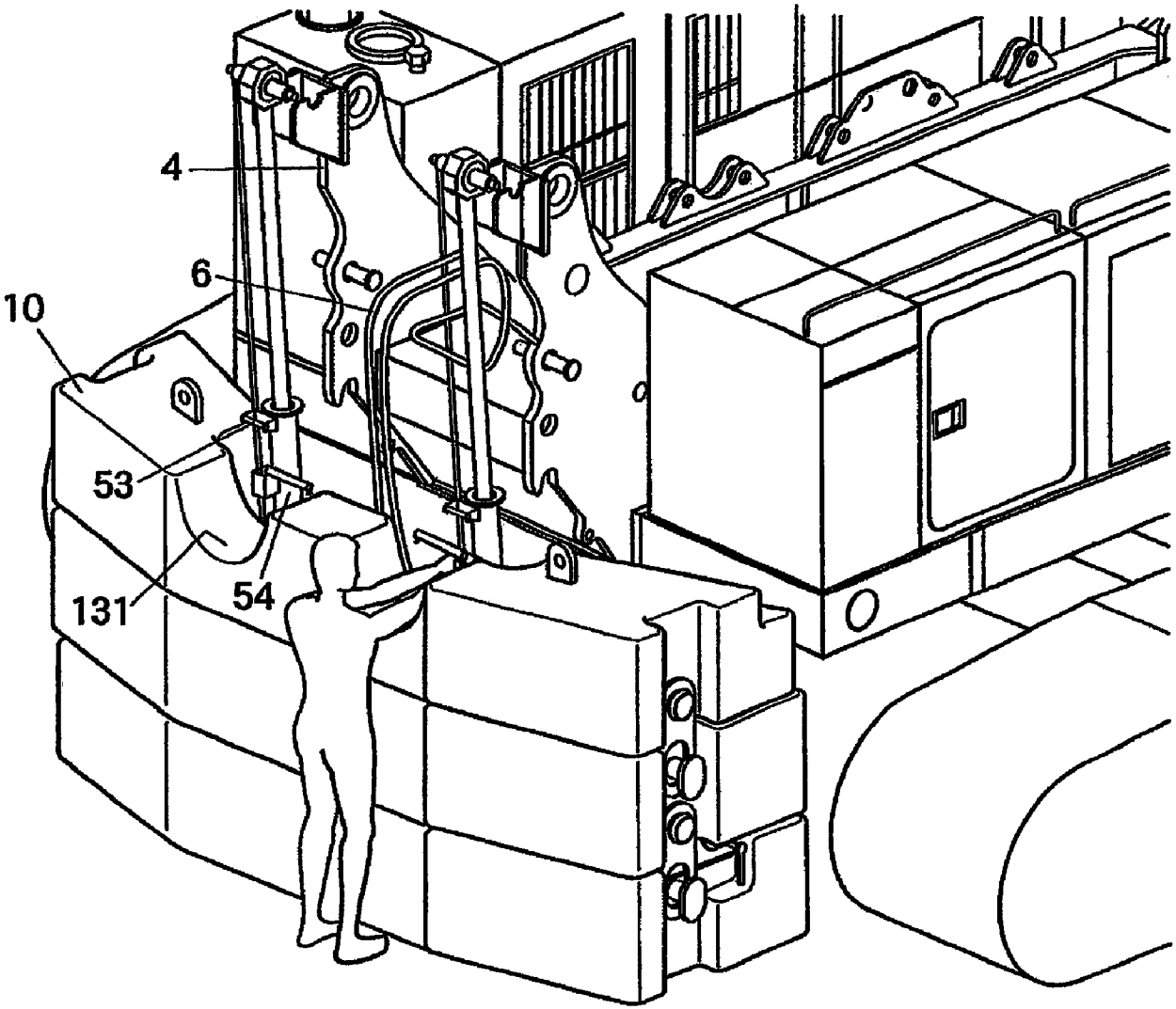
FIG. 5 is a schematic perspective view illustrating the first step of the counterweight mounting procedure.

As shown in FIG. 2, each rod 30 has a double cylinder structure consisting of an inner cylinder 31 and an outer cylinder 32, and a lever 33 is disposed on an end of the outer cylinder 32. The lever 33 is housed in a concave part 112 disposed on a side surface of the lower weight 11. FIGS. 4A and 4B are each a cross-sectional view of the rod 30. A through hole 311 opens at an end of the inner cylinder 31 and corresponding to the through hole 311, through holes (a first through hole 321 and a second through hole 322) open on both ends of the outer cylinder 32, respectively. The position of the outer cylinder 32 with respect to the inner cylinder 31 is set by inserting a lock pin 34 through the through hole 311 of the inner cylinder 31 through either one of the through holes 321 and 322 in the outer cylinder 32. In this case, when the lock pin 34 is inserted through the first through hole 321 and the through hole 311 as shown in FIG. 4A, the total length of rod 30 becomes shorter, and when the lock pin 34 is inserted through the second through hole 322 and the through hole 311 as shown in FIG. 4B, the total length of the rod 30 becomes longer.

The following explanation is on the mounting procedure of the counterweight 10 by using the counterweight installation device according to the first embodiment.

First of all, the operator inserts his or her hands from the rear side of the counterweight 10 along the concave part 131, and connects hydraulic hose 6 with the joint 54 with the counterweight 10 put behind the pair of bracket 4. Next, as shown in FIG. 1, the operator stands behind the counterweight 10 and operates a remote control switch SW to extend the hydraulic cylinder 5 with the pressure oil from the hydraulic pump. As shown in FIG. 2, the hydraulic cylinders 5 are swingably supported by the pins 17, respectively. A position of center of gravity of the hydraulic cylinder 5 shifts backward since the handgrip 53 and the joint 54 are disposed behind the hydraulic cylinder 5, and the hydraulic cylinder 5 extends as the top part thereof inclined backward. Therefore, the rod pin 52 in the top of the piston rod can be prevented from coming in contact with the support brackets 45 when the hydraulic cylinder 5 is extended.

Figure 6:
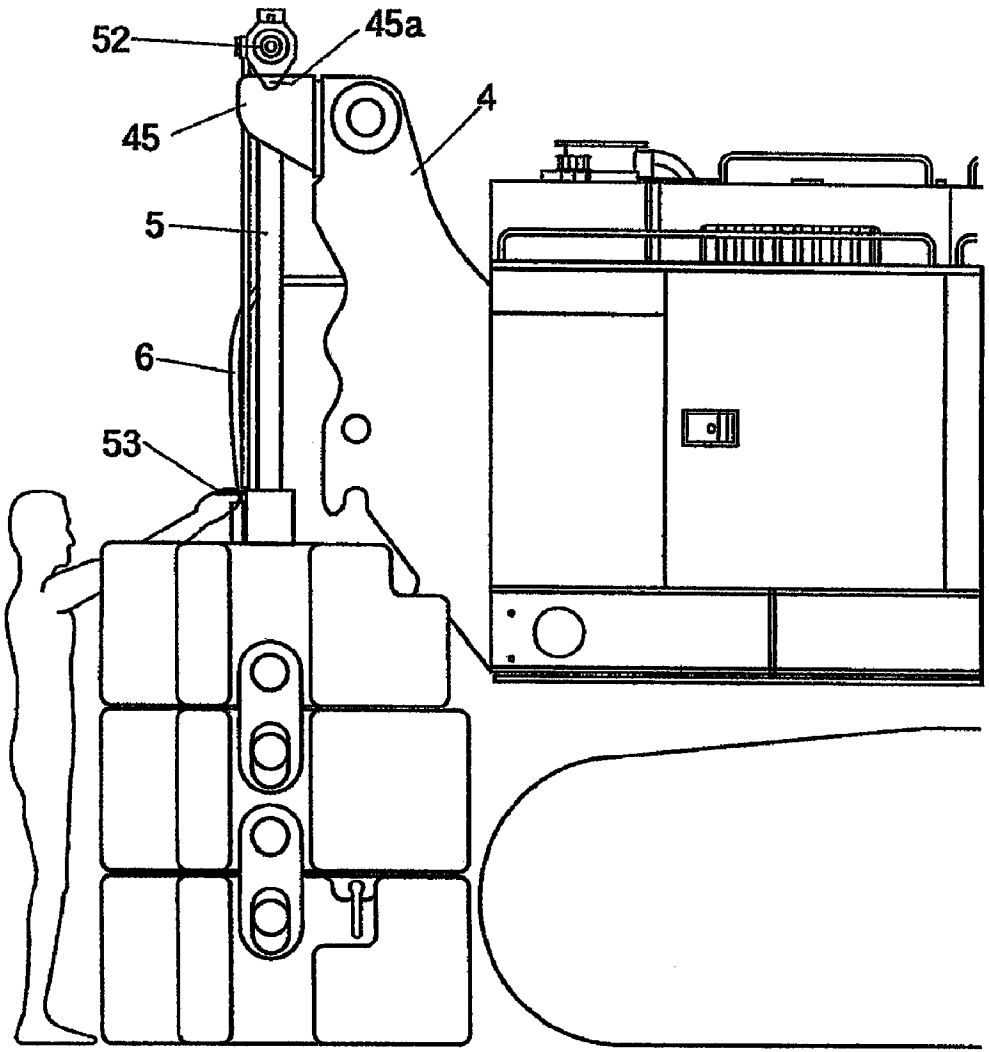
FIG. 6 is a schematic side view illustrating the second step of the counterweight mounting procedure.
Figure 7:
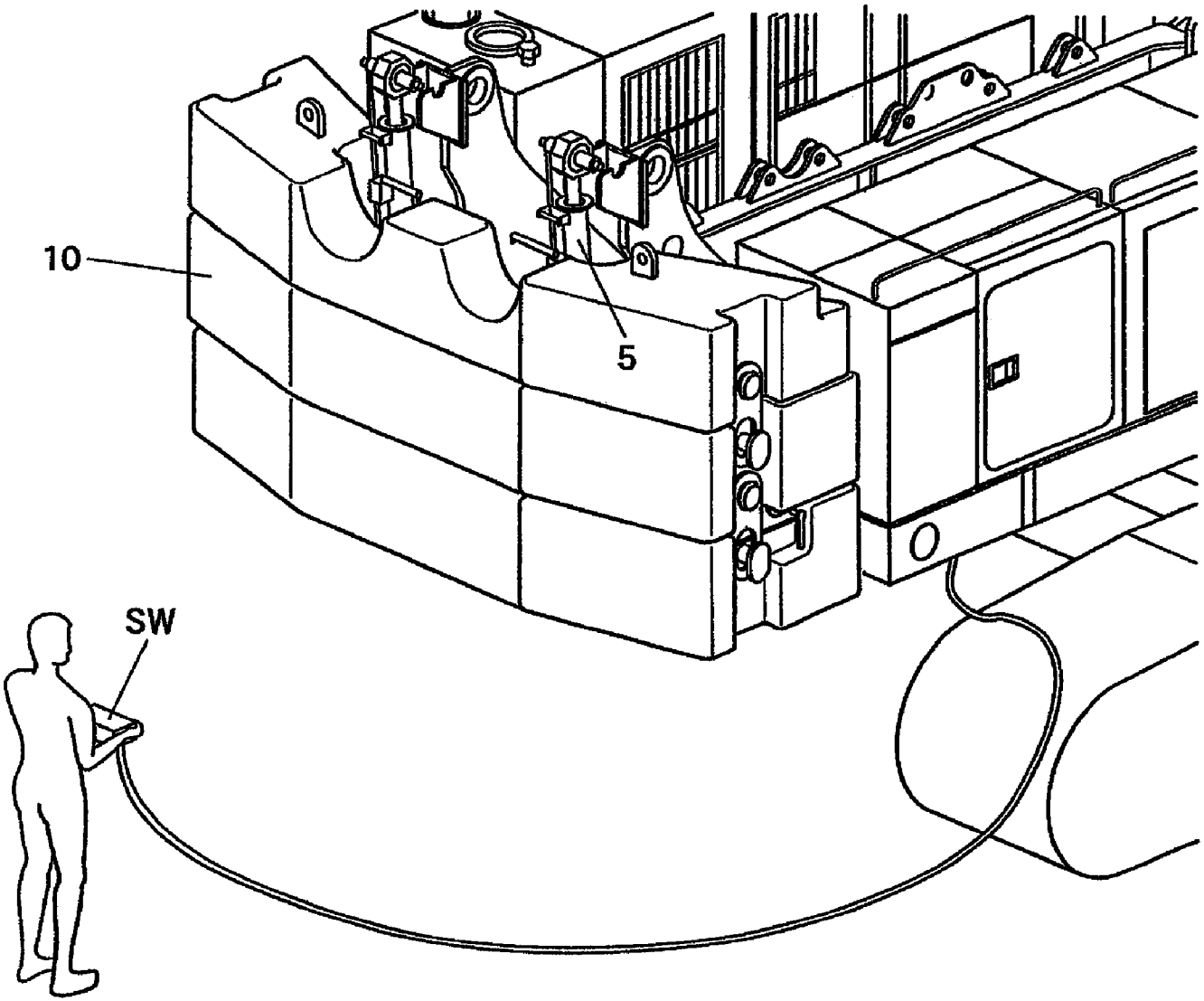
FIG. 7 is a schematic perspective view illustrating the third step of the counterweight mounting procedure.

When the rod pin 52 moves upward above the upper surface of the concave parts 45*a*, the operator stops the extension operation of the hydraulic cylinder 5 with the remote control switch SW. Then, as shown in FIG. 6, the operator inserts his or her hands along the concave part 131 on the upper surface of the counterweight 10, and grabs the handgrip 53 to push the hydraulic cylinder 5 to lean it forward, and move the rod pin 52 to just above the concave parts 45*a* on the upper surface of the support brackets 45. Then the operator operates the remote control switch SW to retract the hydraulic cylinder 5 and engage the rod pin 52 with the concave parts 45*a*. By the above-mentioned procedure, the operator raises the counterweight 10 by operating the remote control switch SW as shown in FIG. 7 in a state where the rod pins 52 of both the right and left hydraulic cylinders 5 are engaged with the concave parts 45*a* of the corresponding support brackets 45.

Figure 9A:
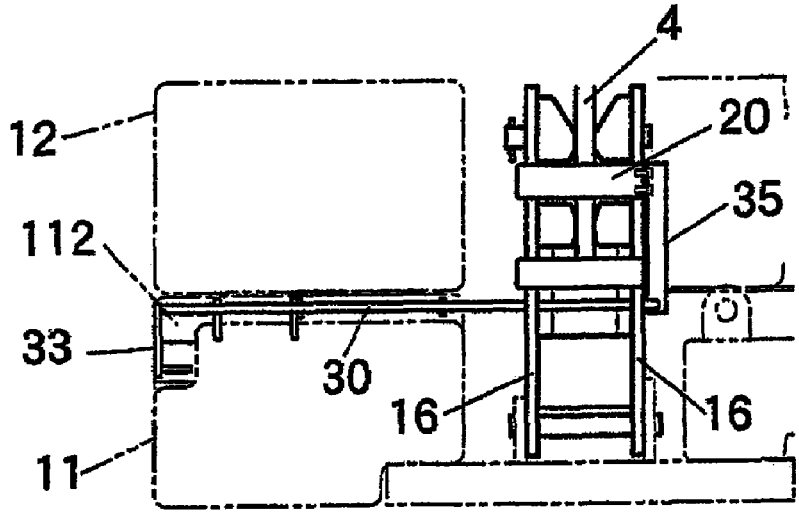
FIG. 9A to FIG. 9C illustrate each the motion of the rod shown in FIGS. 4A and 4B.
Figure 9B:
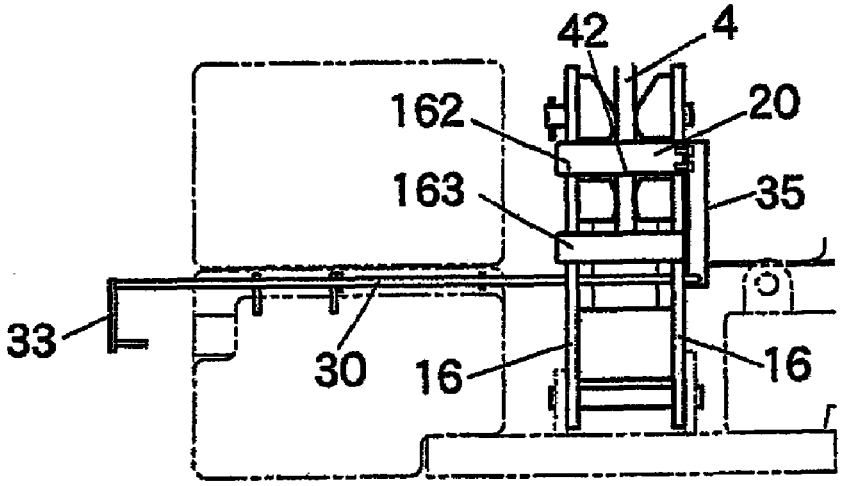
Figure 9C:
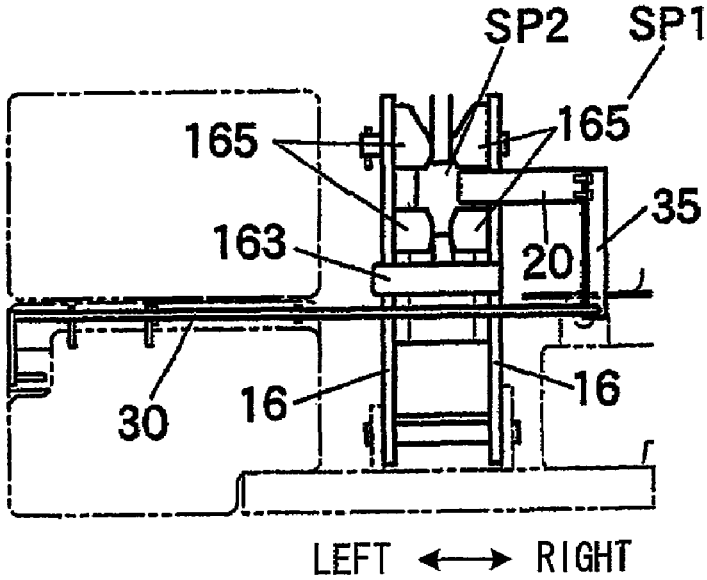

When the counterweight 10 is to be raised, the following procedure is taken in advance. That is, the lock pin 34 is inserted in the second through hole 322 of the outer cylinder 32 and the through hole 311 of the inner cylinder 31 for each of the right and left areas, respectively, as shown in FIG. 4B and the rods 30 are pushed into the depth toward the counterweight 10 along the right and left direction. Under such a condition, the support pin 20 is pushed through the link 35 to move toward the center along the direction of the width of the counterweight 10 (right side of the figure) as shown in FIG. 9C, so that the support pin 20 is retracted into the space SP1 between the right and left hydraulic cylinders 5 (see FIG. 2). When the support pin 20 is at the position of retraction as shown in FIG. 9C, the gap SP2 between the right and left guides 165 disposed between the pair of support plates 16 is opened along the direction of top and bottom, and the corresponding bracket 4 can be inserted in the gap SP2.

Figure 10B:
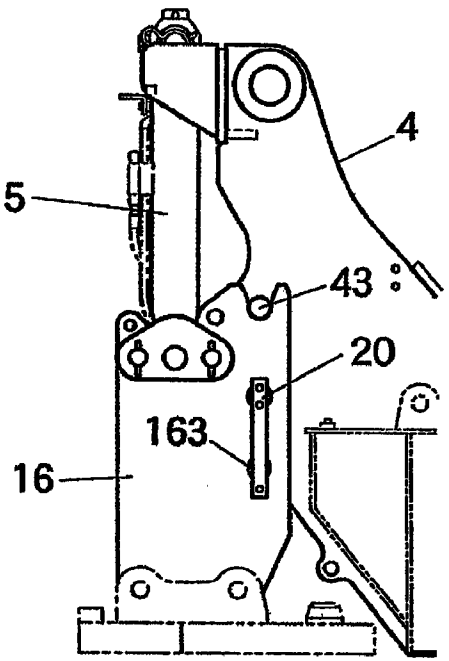
FIGS. 10A and 10B show each the mounting portion of the counterweight, viewed from the side.
Figure 10A:
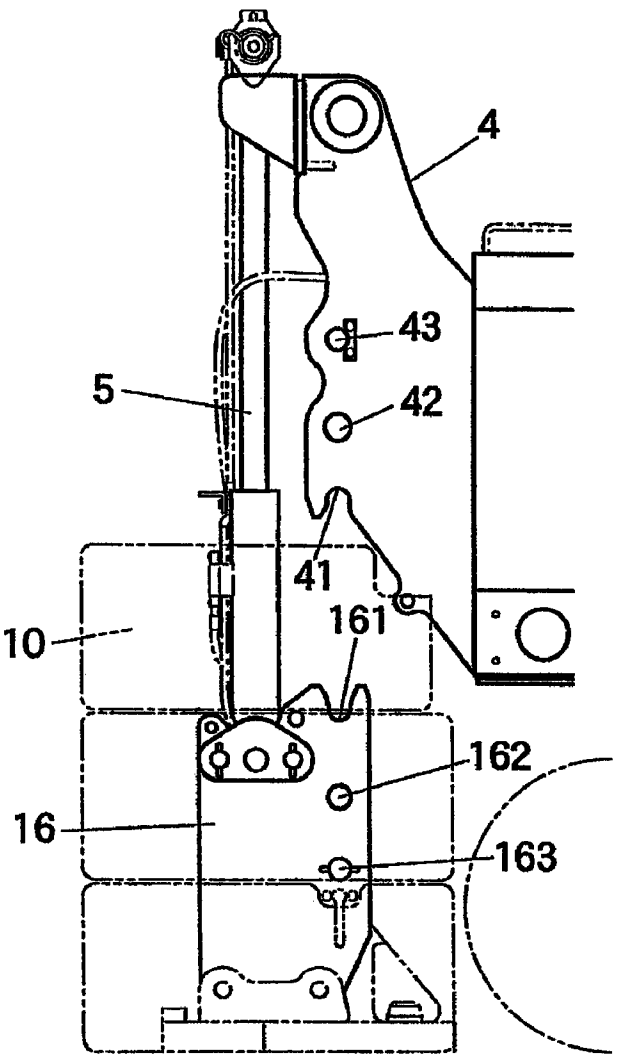

FIGS. 10A and 10B show each the bracket 4 at rear ends of the body frame 3 and the support plates 16 of the counterweight 10 as seen laterally. Here, to simplify the explanation, one of the pair of hydraulic cylinders 5 and the bracket 4 corresponding thereto are explained. When the hydraulic cylinder 5 is retracted from the state shown in FIG. 10A to raise the counterweight 10, the bracket 4 enters the gap SP2 defined by the right and left guides 165 provided between the pair of support plates 16. As a result, when the counterweight 10 is raised, the position of the counterweight 10 along the right and left direction is restrained by the guides 165.

When the counterweight 10 is raised to a specific extent, the guide pins 43 of the bracket 4 move into the guide grooves 161 on the upper surface of the support plates 16 and the guide pin 163 of the support plates 16 moves into the guide groove 41 on the lower surface of the bracket 4. Thus, the guide pins 43 and 163 move along the guide grooves 161 and 41, respectively, to correct the posture at which the counterweight 10 is mounted. When the guide pins 43 and 163 reach the innermost areas of the guide grooves 161 and 41, respectively, the operator stops the retraction operation of the hydraulic cylinder 5. At this time, the position of the through holes 162 of the support plates 16 and the position of the through hole 42 of the bracket 4 agree with each other with precision since the support plates 16 are held in position to the bracket 4 by the guide pins 43 and 163 in the top and bottom two places.

Figure 8:
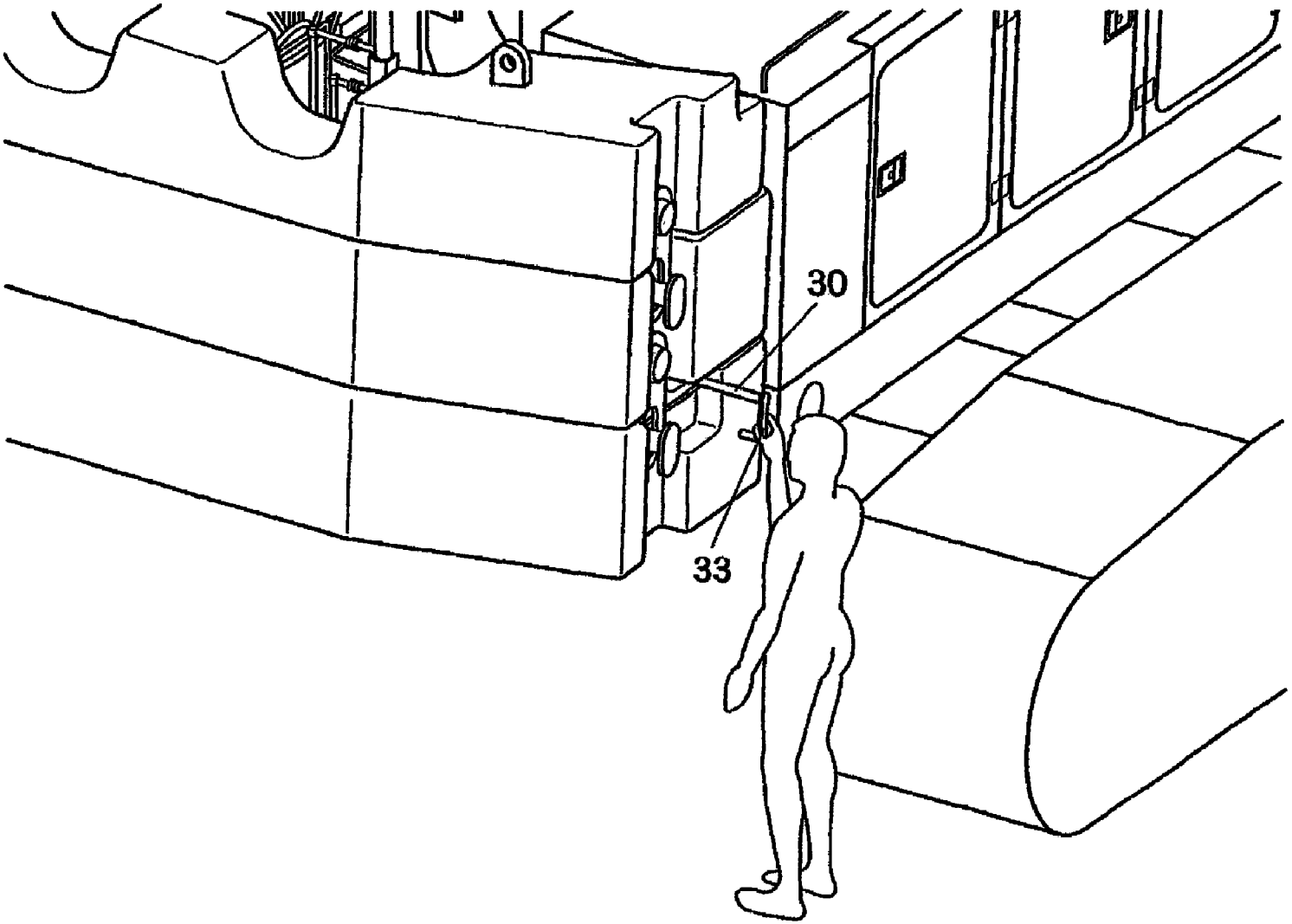
FIG. 8 is a schematic perspective view illustrating the fourth step of the counterweight mounting procedure.

Next, the operator pulls the lever 33 at the edge of the rod 30 on the side of the counterweight 10 as shown in FIG. 8. As a result, the support pin 20 penetrates through the through holes 42 and 162 as shown in FIG. 9B and moves outward along the width direction (left side of figure) of the revolving superstructure 2 and the counterweight 10. When the support pin 20 is at the position of penetration shown in FIG. 9B, the counterweight 10 is supported on the bracket 4 through the support pin 20. Next, the operator pulls out the lock pin 34 of the rod 30 and pushes the rod 30 into the depth (right side of figure) to move the outer cylinder 32 along the inner cylinder 31. Then, the lock pin 34 is inserted through the through hole 321 of the outer cylinder 32 and the through hole 311 of the inner cylinder 31 as shown in FIG. 4A, and the lever 33 is housed in the concave part 112 of the side surface of the lower weight 11 as shown in FIG. 9A. The levers 33 are similarly housed for the rods 30 in the right area and the left area.

Finally, the hydraulic cylinder 5 is extended by operating the remote control switch SW, and the rod pin 52 in the top part of the piston rod is disengaged from the concave parts 45*a*. Thereafter, the hydraulic cylinder 5 is retracted by operating the remote control switch SW, and the rod of the hydraulic cylinder 5 is housed in the inside space SP1 of the counterweight 10. When the above-mentioned operation is done for both the hydraulic cylinders 5, the work of installing the counterweight 10 is ended. The counterweight 10 is dismounted by reversing the mounting procedure.

The following operational advantages can be achieved in the first embodiment described above.

Figure 11:
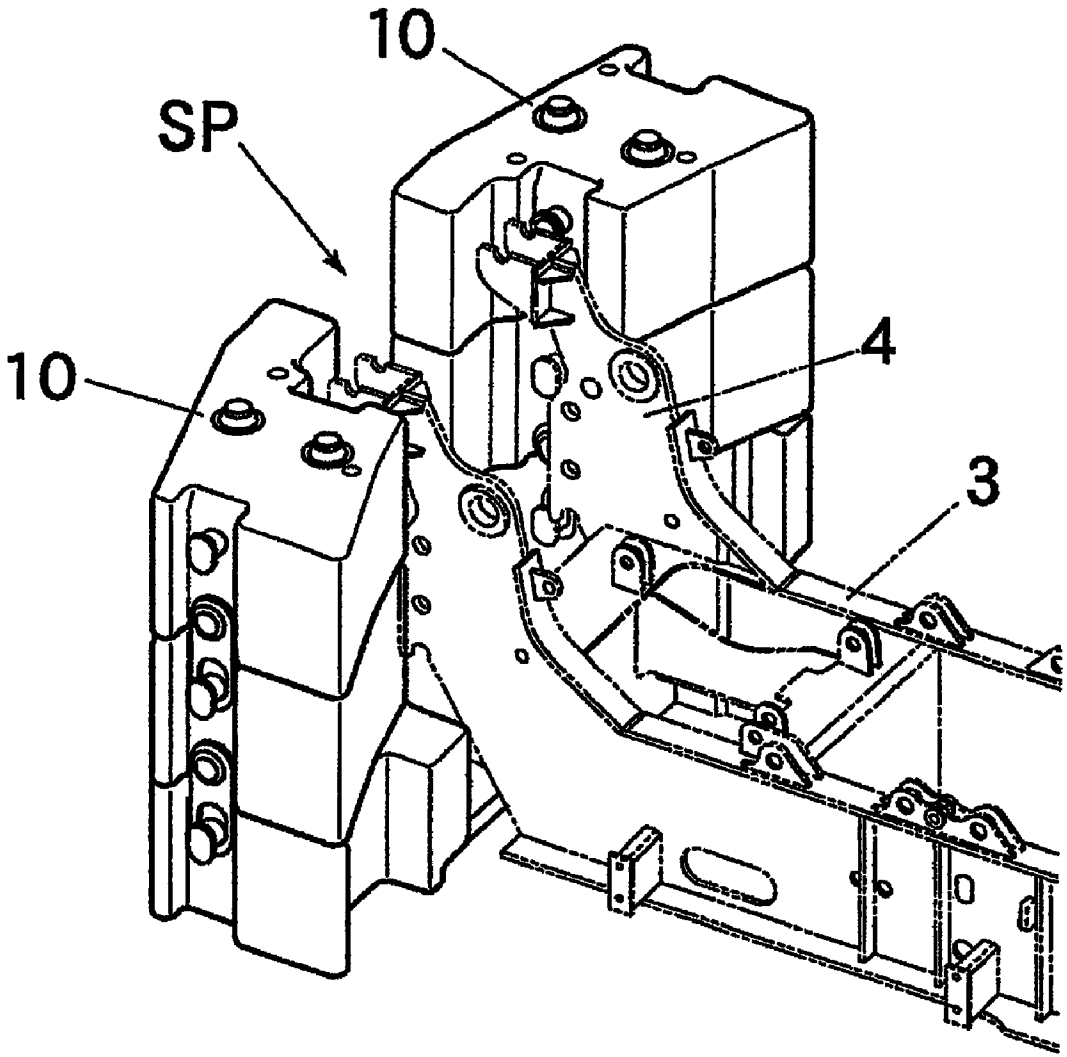
FIG. 11 is a perspective view showing the structure adopted in a counterweight device according to a comparative example.
Figure 12:
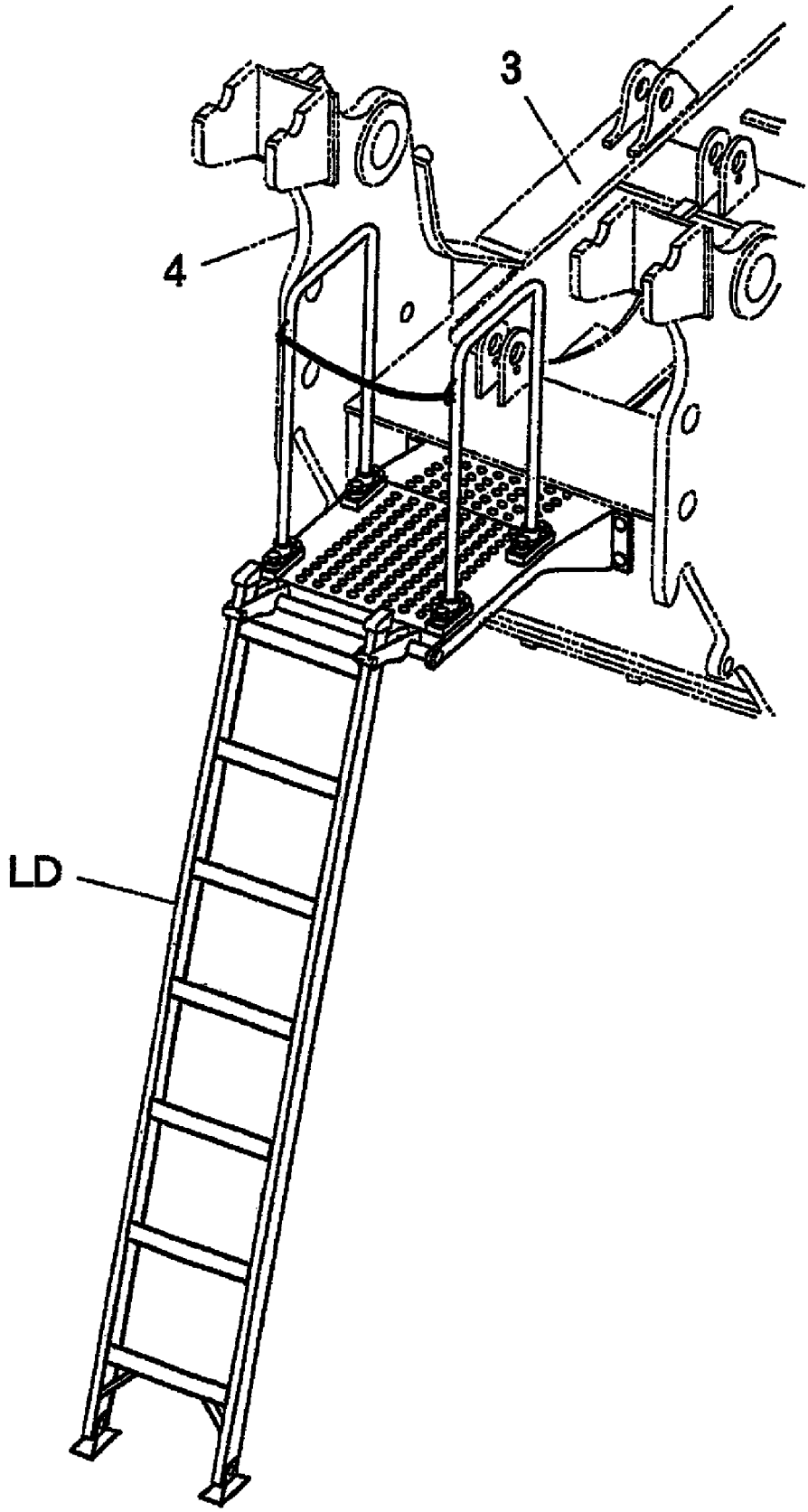
FIG. 12 is a partial perspective view showing an example of the counterweight according to the comparative example, in which a ladder is attached for the counterweight mounting procedure.

(1) The rod 30 is housed in a state where it is slidable along the right and left direction in the groove 111 on the upper surface of the lower weight 11, and the support pin 20 is inserted into the through hole 42 of the bracket 4 by pulling the rod 30 along the right and left direction on the side of counterweight 10. Since this makes it unnecessary to provide a work space for inserting the support pin 20 in the counterweight 10, the weight of the counterweight 10 can be prevented from being decreased and the size of the counterweight 10 can be prevented from growing bigger. On the contrary, when the support pin 20 is to be inserted from the inside of the counterweight 10, the work space SP should be secured, for example, by dividing the counterweight 10 into two parts, i.e., a right part and a left part as shown in FIG. 11, and the weight of the counterweight 10 decreases accordingly.

(2) Since the concave part 113 is provided on the upper surface of the counterweight 10, the operator can perform the attaching or detaching of the hydraulic hose 6 and the swing operation etc. of hydraulic cylinder 5 by inserting his or her hands from the rear side of the counterweight 10 along the concave part 113. Therefore, the operator need not climb the upper part of the body of the construction machine with a ladder etc., and can work easily and safely. Since this eliminates the need to provide a space for mounting a ladder, the shape of the counterweight 10 is not limited so much and the weight of the counterweight can be prevented from being decreased. On the contrary, when the ladder LD is mounted to the rear end of the body frame 3 as shown in, for example, FIG. 12, the counterweight 10 should be divided into two parts, i.e., a right part and a left part as shown in FIG. 11, so that the ladder LD and the counterweight 10 do not interfere with each other in FIG. 11, and the weight of the counterweight 10 is compromised accordingly.

(3) Since the rod 30 that penetrates through the pair of support plates 16 is disposed, and the support pin 20 is allowed to be moved to the space SP1 (retraction position) between the right and left hydraulic cylinders 5 by the operation of pushing the rod 30, the retraction space for the support pin 20 need not be created outside of the pair of support plates 16 along the right and left direction, so that the weight of the counterweight 10 can be increased.

(4) Since the handgrip 53 is provided on the rear surface of each hydraulic cylinder 5 and the concave part 131 is formed on the upper surface of the counterweight 10 corresponding to the position of each handgrip 53, the operator can rock the hydraulic cylinder 5 by operating the handgrip 53 from the outside of the counterweight 10. Therefore, the inclination of the hydraulic cylinder 5 can be easily changed. This allows the operator to make an operation on the ground in order to engage the top part of the hydraulic cylinder 5 with the support brackets 45, thus facilitating the installation work of counterweight 10.

(5) Since the pair of support plates 16 are held in position on the bracket 4 by the engagement of the guide pin 43 with the guide grooves 161 and of the guide pin 163 with the guide groove 41, the position of the through hole 162 of the support plates 16 and the position of the through hole 42 of the bracket 4 can be matched with precision. As a result, even if the through holes 162 and 42 are not watched, the support pin 20 could be easily inserted through the through holes 162 and 42.

(6) When the support pin 20 is either at the position of penetration as shown in FIG. 9A, or at the position of retraction as shown in FIG. 9C, the lever 33 can be housed in the concave part 112 on the side surface of the lower weight 11 since the rod 30 is made to have a double cylinder structure and the length of the rod 30 is made variable. Since the lever 33 of the rod 30 is housed in the concave part 112 of the lower weight 11 in the position of penetration as shown in FIG. 9A, the movement of the support pin 20 relative to the counterweight 10 along the right and left direction is prevented. That is, the lever 33 functions as a retaining member for retaining the support pin 20 by shortening the length of the rod 30 to enable the lever 33 to be housed in the concave part 112 when the support pin 20 is in the position of penetration.

While the hydraulic cylinder 5 is constructed such that it is driven by the pressure oil from the hydraulic pump mounted in the revolving superstructure 2 in the above-mentioned first embodiment, the hydraulic cylinder 5 may be driven by the pressure oil from an outside hydraulic source. The counterweight 10 may be lifted by use of an auxiliary crane or the like and mounted to the rear end of the body without disposing the hydraulic cylinder 5. The shape of the rod 30 is made a linear form along the groove 111 of the lower weight 11. However, the shape of the rod 30 as the rod member is not limited to the one mentioned above as long as a construction is adopted in which one end of the rod 30 is connected to the support pin 20 and the other end of the rod 30 is extended to project outside of the counterweight 10 to enable the support pin 20 to be moved between the position of penetration (a first position)

and the position of retraction (a second position). For example, the rod 30 may be bent along the way.

The rod 30 may be provided so as to be projected from a position other than the both side surfaces (for example, from the rear surface) of the counterweight 10. While the rod 30 is housed in the groove 111 on the upper surface of the lower weight 11, the rod 30 may be supported, for example, by providing a through hole in the counterweight 10 or the rod 30 may be supported along the lower surface of the lower weight 11. Although the support pin 20 is retracted in the space SP1 between the right and left hydraulic cylinders 5, it may be retracted at other positions. The shape of the support pin 20 as the pin member may be of any type and the pin member may be inserted in any structure other than the through holes 42 and 162.

While the pair of support plates 16 of the counterweight 10 is mounted to the bracket 4 disposed on the rear end part of the body frame 3, the construction of the weight support unit and that of the weight mounting unit is not limited to those mentioned above. While the concave portion (recess) 131 was formed on the upper surface of the counterweight 10, the shape of the recess is not limited to the one mentioned above as far as it is formed such that he hydraulic cylinder 5 or the circumference can be operated from behind. While the handgrip 53 is disposed on the rear surface of the hydraulic cylinder 5 as a gripper, the shape of the gripper may be of any acceptable one. While the guide grooves 41 and 161 (engaging grooves) and the guide pins 43 and 163(engaging members) are formed in the bracket 4 and the pair of support plates 16, respectively, and the pair of support plates 16 is held in position to the bracket 4 by the engagement of the engaging grooves with the engaging members, the construction of the positioning means is not limited to this.

Second Embodiment

The following is an explanation of a second embodiment of a counterweight device according to the present invention.

In the first embodiment mentioned above, when the support pin 20 is in the position of penetration shown in FIG. 9A and in the position of retraction shown in FIG. 9C, the lever 33 for inserting and removing the support pin 20 is housed in the concave part 112 of the side surface of the lower weight 11. That is, the state of the lever 33 is the same between the positions of penetration and of retraction of the support pin 20, so that it can not be confirmed from outside of the counterweight 10 as to whether the support pin is in the position of penetration or in the position of retraction.

Then, the second embodiment is adapted such that the state of the insertion of the support pin 20 can be confirmed from the outside of the counterweight 10 by making the rod 30 for inserting and removing the support pin 20 foldable.

Figure 13A:
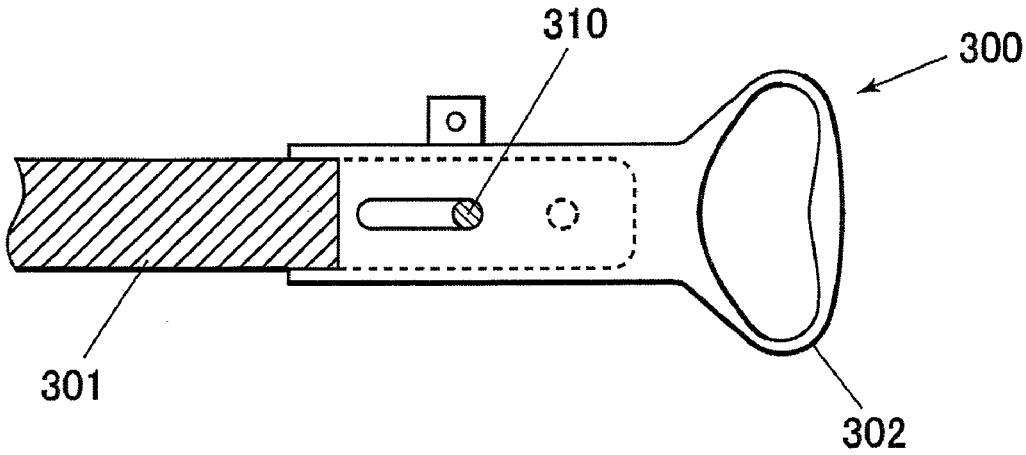
FIGS. 13A and 13B are each a cross-sectional view of a rod constituting the counterweight installation device according to the second embodiment.
Figure 13B:
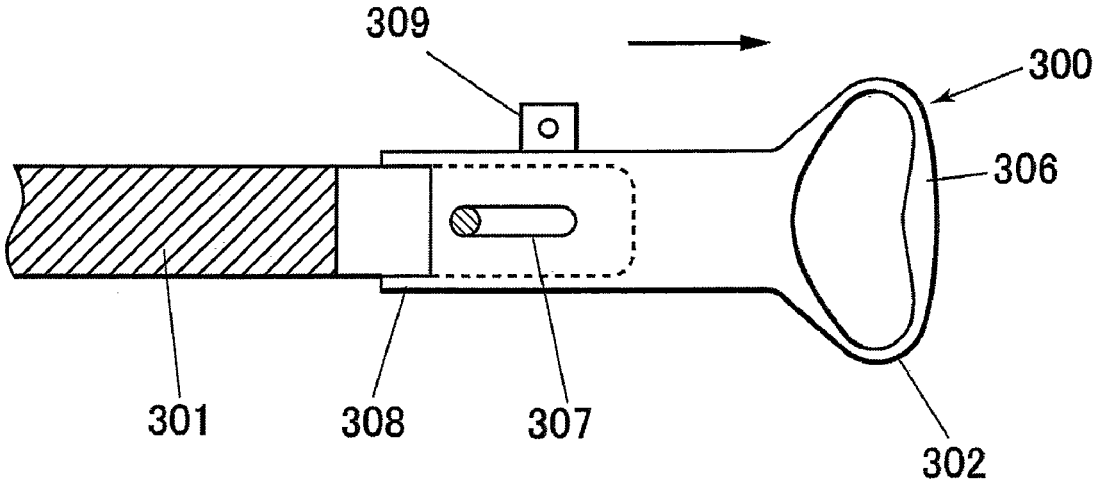
Figure 15A:
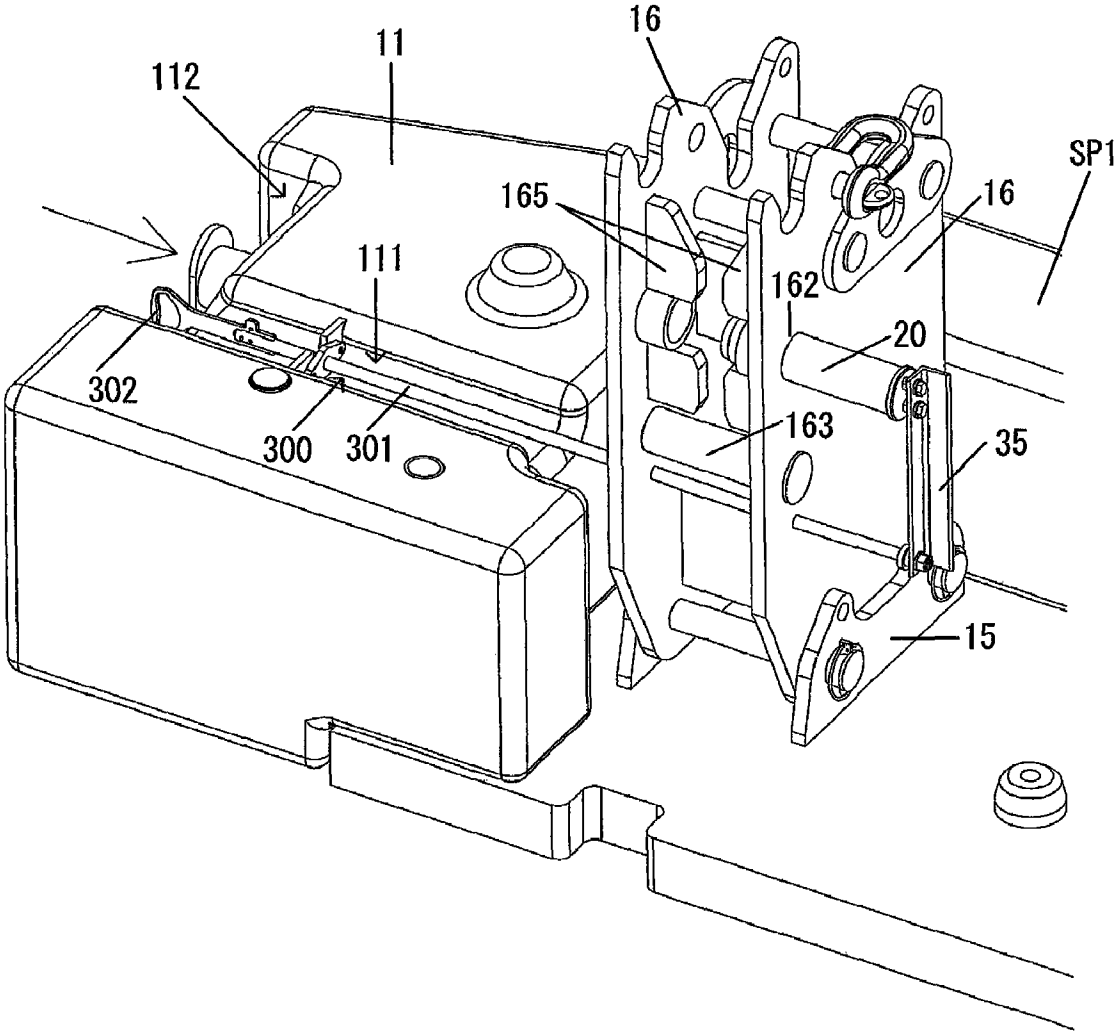
FIGS. 15A and 15B are perspective views each showing the state before a support pin is inserted with a pin operating rod.

FIGS. 13A and 13B are each a cross-sectional view of a rod 300 for operating the pin (hereafter, pin operating rod 300) in the second embodiment. The pin operating rod 300 includes a rod member 301 and a rod operating member 302 linked to one end of the rod member 301 for sliding the rod member 301 relative to the counterweight 10. For instance, the other end of the rod member 301 penetrates through the pair of support plates 16 similarly to the first embodiment mentioned above and is linked to the link 35 as shown in FIG. 15A. The pin operating rod 300 can move the support pin 20 through the link 35.

Figure 14:
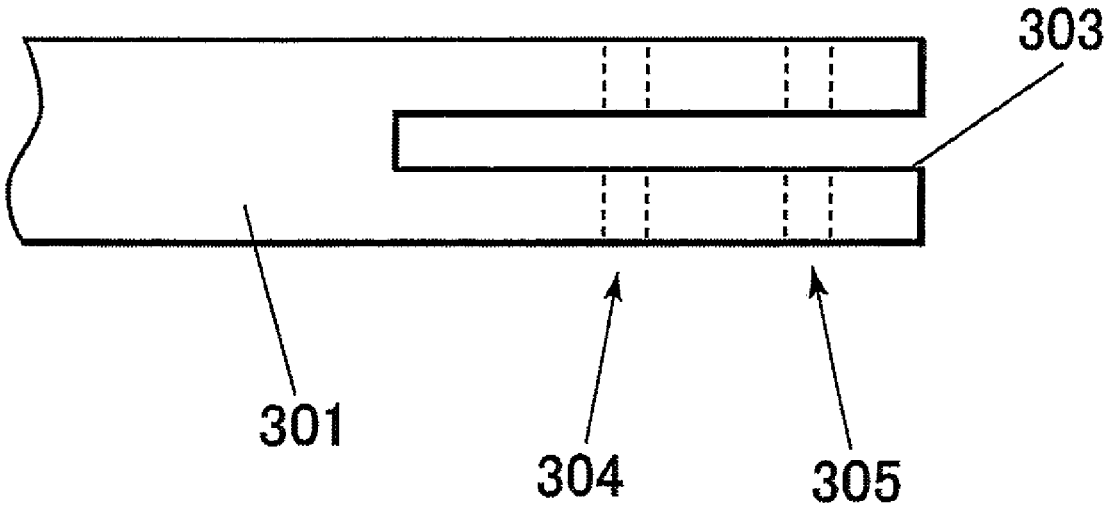
FIG. 14 is a cross-sectional view showing a part of a rod member connected to a rod operating member.

FIG. 14 is a figure showing the connecting part of the rod member 301 with the rod operating member 302 seen from above. In the leading edge of the rod member 301 along the longitudinal direction of the rod member 301, a groove 303 is formed and through holes 304 and 305 are formed in an orthogonal direction to the groove 303. As shown in FIGS. 13A and 13B, the rod operating member 302 is formed of a handgrip 306 to be grabbed by the operator for its operation, a slot 307, a groove 308 formed at an opposite end to the handgrip 306, and a through hole 309. The slot 307 is formed along the longitudinal direction of the rod member 301. The rod member 301 and the rod operating member 302 are linked by inserting the rod operating member 302 in the groove 303 of the rod member 301, and inserting a pin 310 through the through hole 304 of the rod 301 and the slot 307 of the rod operating member 302.

The rod operating member 302 is adapted to be movable in the longitudinal direction along the rod member 301 in the longitudinal extent of the slot 307. Moreover, the rod operating member 302 is adapted to be swingable about the rod member 301 with the pin 310 as a center. The pin operating rod 300 can be folded by swinging the rod operating member 302 relative to the rod member 301.

When the operator pushes the rod operating member 302 farther into the interior side of the counterweight 10 by gripping the handgrip 306 with the pin operating rod 300 not folded, the groove 308 of the rod operating member 302 is pressed against the innermost part of the groove 303 of the rod member 301 as shown in FIG. 13A, and the rod member 301 slides farther into the interior side of the counterweight 10. When the operator grips the handgrip 306 and pulls it to draw out the rod operating member 302 outside of the counterweight 10, the rod member 301 is drawn out through the pin 310 inserted through the slot 307.

Figure 15B:
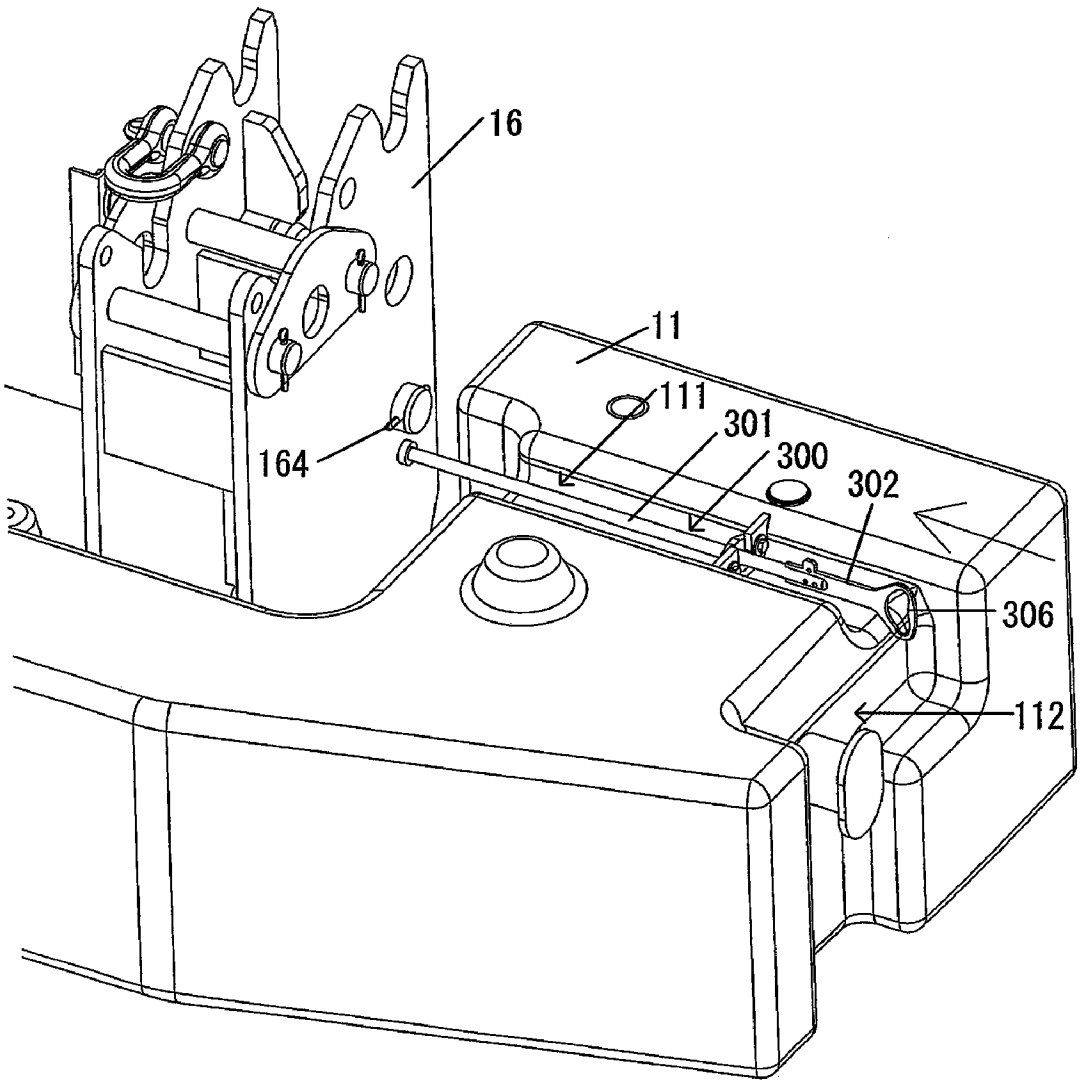
Figure 16A:
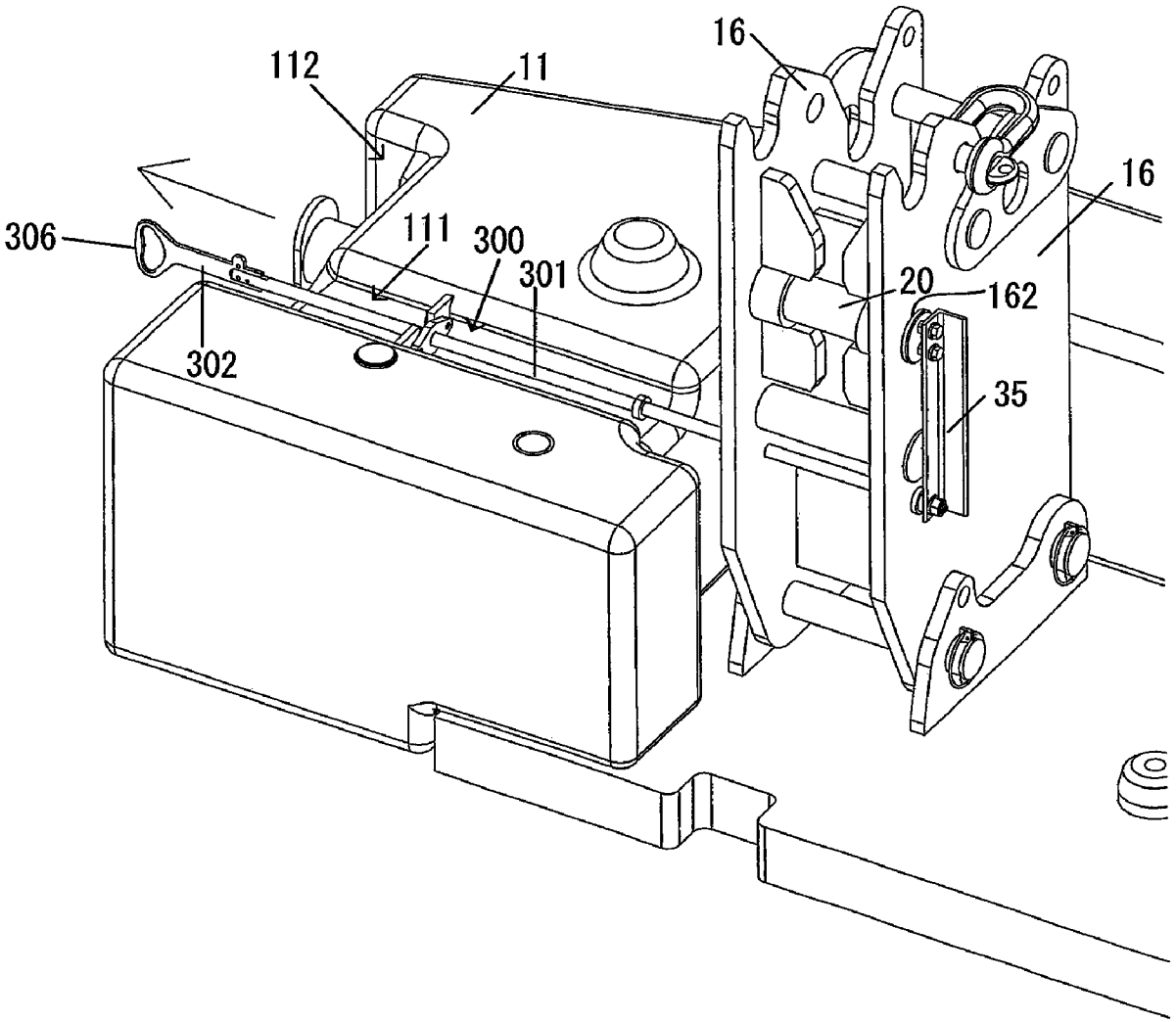
FIGS. 16A and 16B are perspective views each showing the state in which the support pin is inserted with the pin operating rod.
Figure 16B:
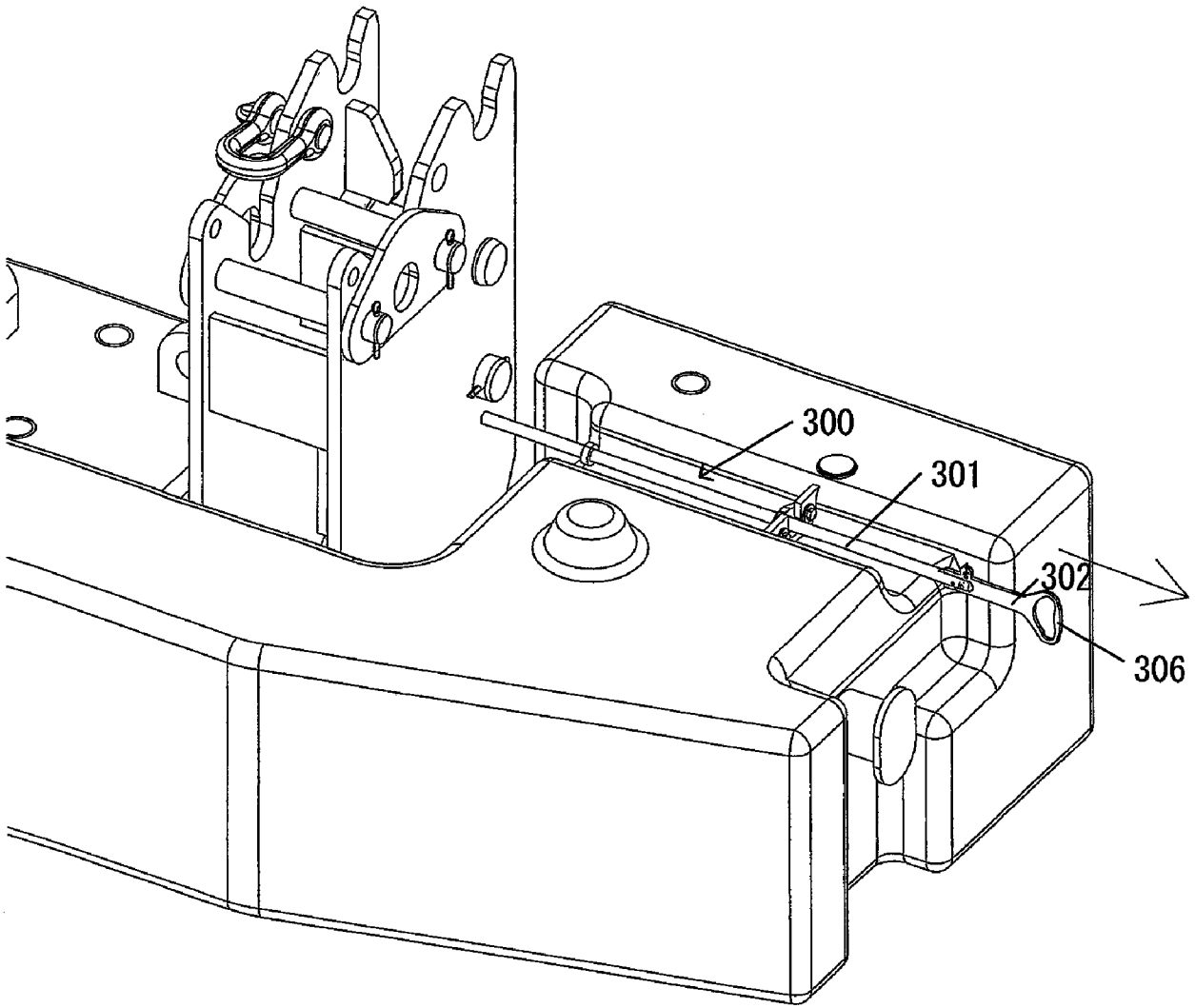
Figure 17A:
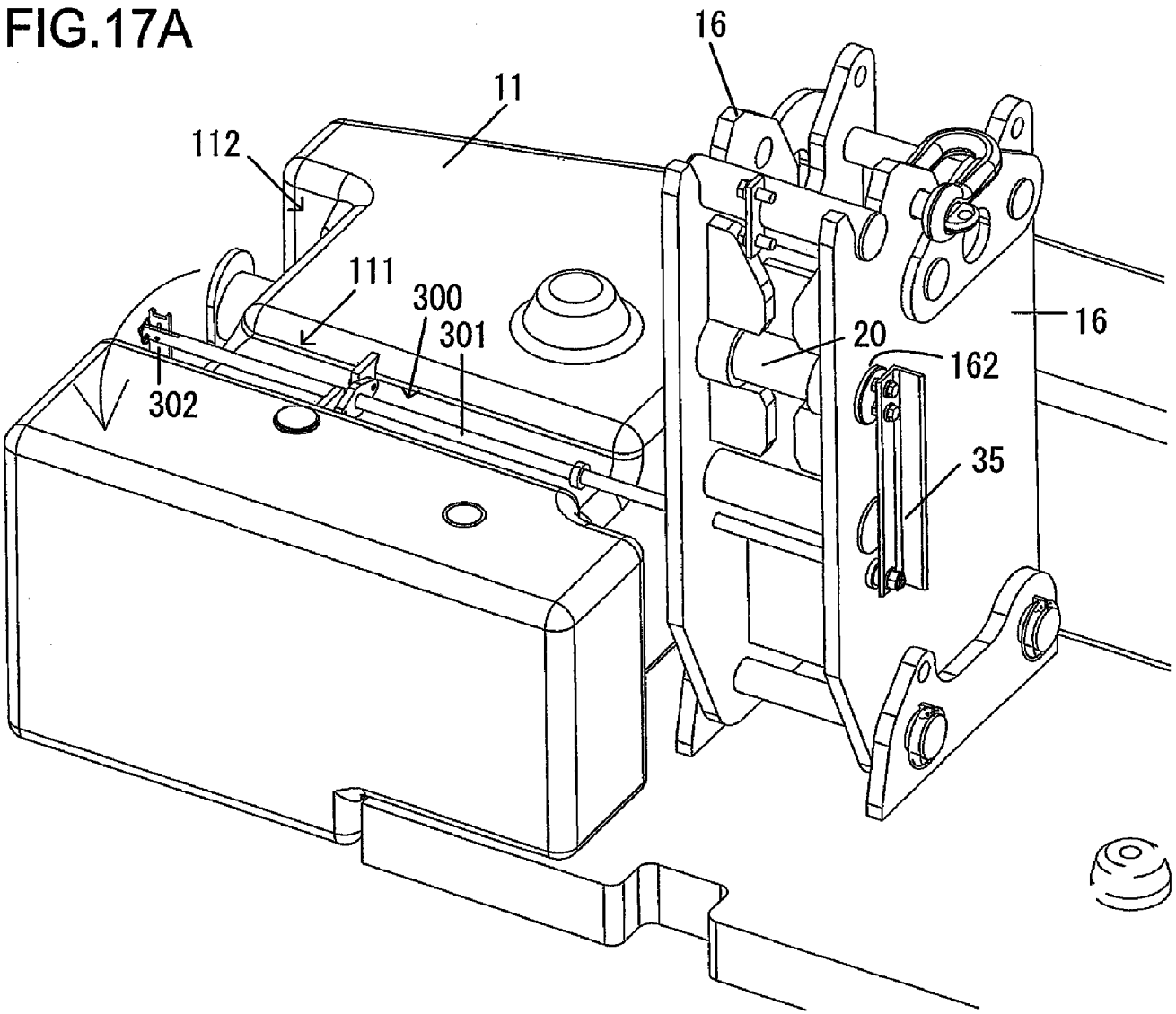
FIGS. 17A and 17B are perspective views each showing the state in which the rod operating member is stored after the support pin is inserted with the pin operating rod.
Figure 17B:
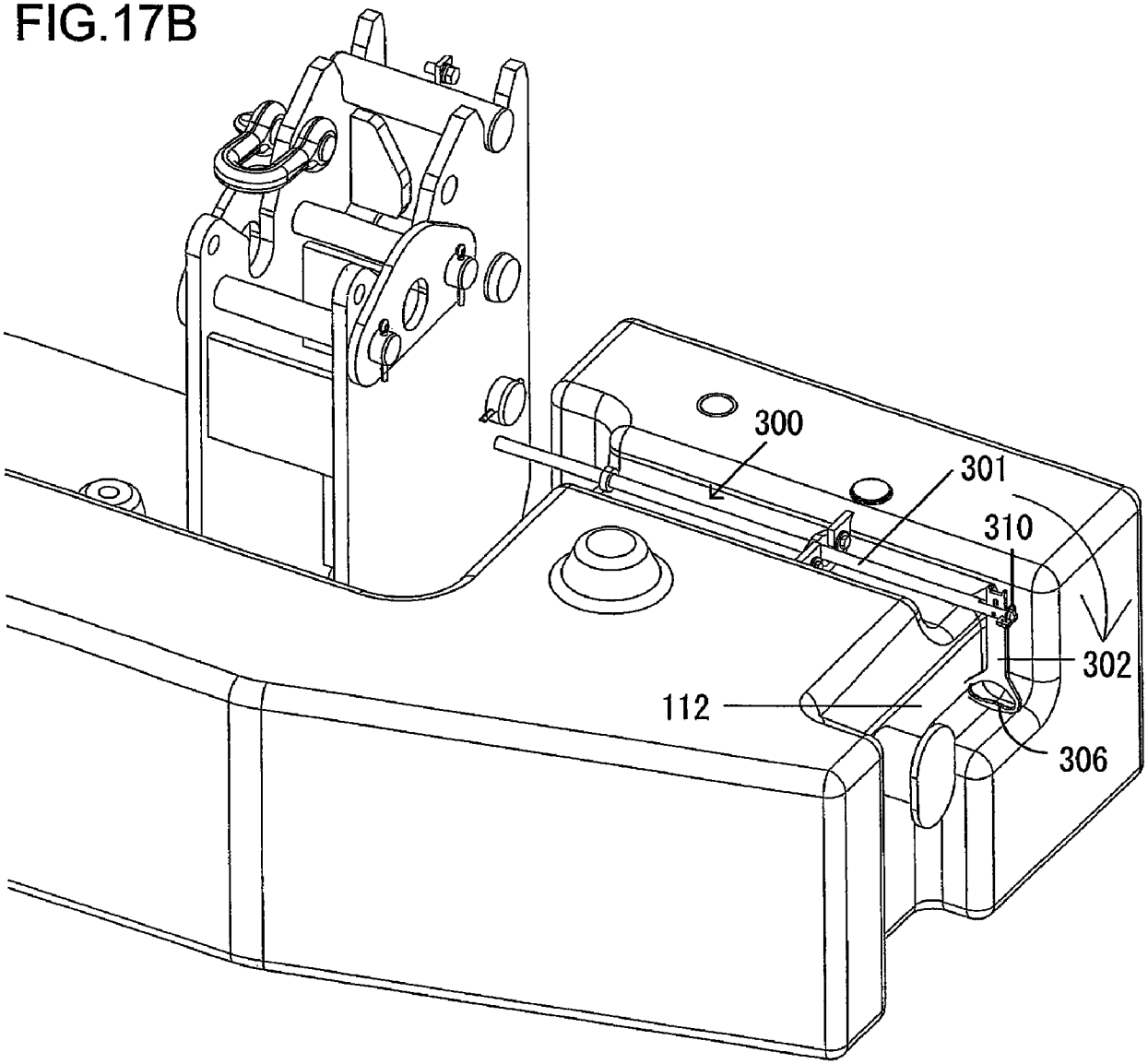

The movement of the pin operating rod 300 and the support pin 20 is described as follows. FIGS. 15A, 16A, and 17A are each a perspective view of the counterweight 10 as seen obliquely from front and FIGS. 15B, 16B, and 17B are each a perspective view of the counterweight 10 as seen obliquely from back. FIGS. 15A to 17B show only a left area of the counterweight 10, with the weights 12 and 13 as well as the brackets 4 being omitted to simplify the explanation.

As shown in FIGS. 15A and 15B, when the rod member 301 is pushed farther into the interior side of the counterweight 10 by the rod operating member 302, the support pin 20 moves to a center side of the counterweight 10 along the direction of width thereof through the link 35. As a result, the support pin 20 is retracted in the space SP1 between the right and left hydraulic cylinders 5. Under such a condition, the bracket 4 can be inserted between the pair of support plates 16.

The pin operating rod 300 is not folded as shown in FIGS. 15A and 15B when the support pin 20 is at the retraction position, and almost the whole of the pin operating rod 300 is housed in the groove 111 disposed on the upper surface of the lower weight 11. Only the handgrip 306 of the rod operating member 302 projects from the groove 111 to the concave part 112 on the side surface of the lower weight 11.

After holding in position the bracket 4 relative to the pair of support plates 16, the operator pulls the handgrip 306 to the near side on the side of the counterweight 10. As a result, the support pin 20 penetrates through the through holes 162 of the support plates 16 and the through hole 42 of the bracket 4 as shown in FIGS. 16A and 16B, and the support pin 20 moves outward in the direction of the width of the counterweight 10. When the support pin 20 is in the position of penetration, the counterweight 10 is supported by the bracket 4 with the support pin 20.

As shown in FIGS. 16A and 16B, when the support pin 20 moves to the position of penetration, the rod operating member 302 of the pin operating rod 300 projects from the concave part 112 on the side surface of the lower weight 11.

After the support pin 20 has moved to the position of penetration, the rod operating member 302 is swung downward relative to the rod member 301 as shown in FIGS. 17A and 17B. A ring pin 310 is inserted through the through hole 305 of the rod member 301 and the through hole 309 of the rod operating member 302 with the rod operating member 302 being swung. As a result, the pin operating rod 300 is fixed in a folded state. The rod operating member 302 is housed in the concave part 112 on the side surface of the lower weight 11 without projecting, with the pin operating rod 300 folded. At this time, the handgrip 306 of the rod operating member 302 comes in contact with the concave part 112 to prevent the support pin 20 of the counterweight 10 from being moved in the direction of the width of the counterweight 10. That is, the handgrip 306 of the rod operating member 302 functions as a retaining member for the support pin 20.

As described above, the state of insertion of the support pin 20 can be easily confirmed from the outside of the counterweight 10 by constructing the pin operating rod 300 to be foldable. To be concrete, when the pin operating rod 300 is folded as shown in FIGS. 17A and 17B, it is known that the support pin 20 is in the position of penetration in which the support pin 20 is inserted through the through holes 162 of the pair of the support plates 16 and through the through hole 42 of the bracket 4. Moreover, when the pin operating rod 300 is housed in the groove 111 of the lower weight 11 and can not be folded as shown in FIGS. 15A and 15B, it is known that the support pin 20 is in the position of retraction in which the support pin 20 has not been inserted through the through holes 162 of the pair of the support plates 16 and through the through hole 42 of the bracket 4.

Thus, the state of insertion of the support pin 20 could be easily confirmed from the outside of the counterweight 10. As a result, the operator can perform operations of inserting and removing the support pin 20 on the ground with ease and in addition need not take time to go up to the upper part of the body of the construction machine in order to confirm the state of insertion of the support pin 20.

The mechanism to change the length of the pin operating rod 300 becomes unnecessary since the pin operating rod 300 is constituted by the rod member 301 and the rod operating member 302 linked by the pin 310, so that it can be folded. As a result, the member for inserting the support pin 20 is simplified, and the cost can be decreased. Moreover, the work to change the length of the pin operating rod 300 need not be done for each insertion and removal of the support pin 20, so that the manpower of the work can be decreased.

Figure 18:
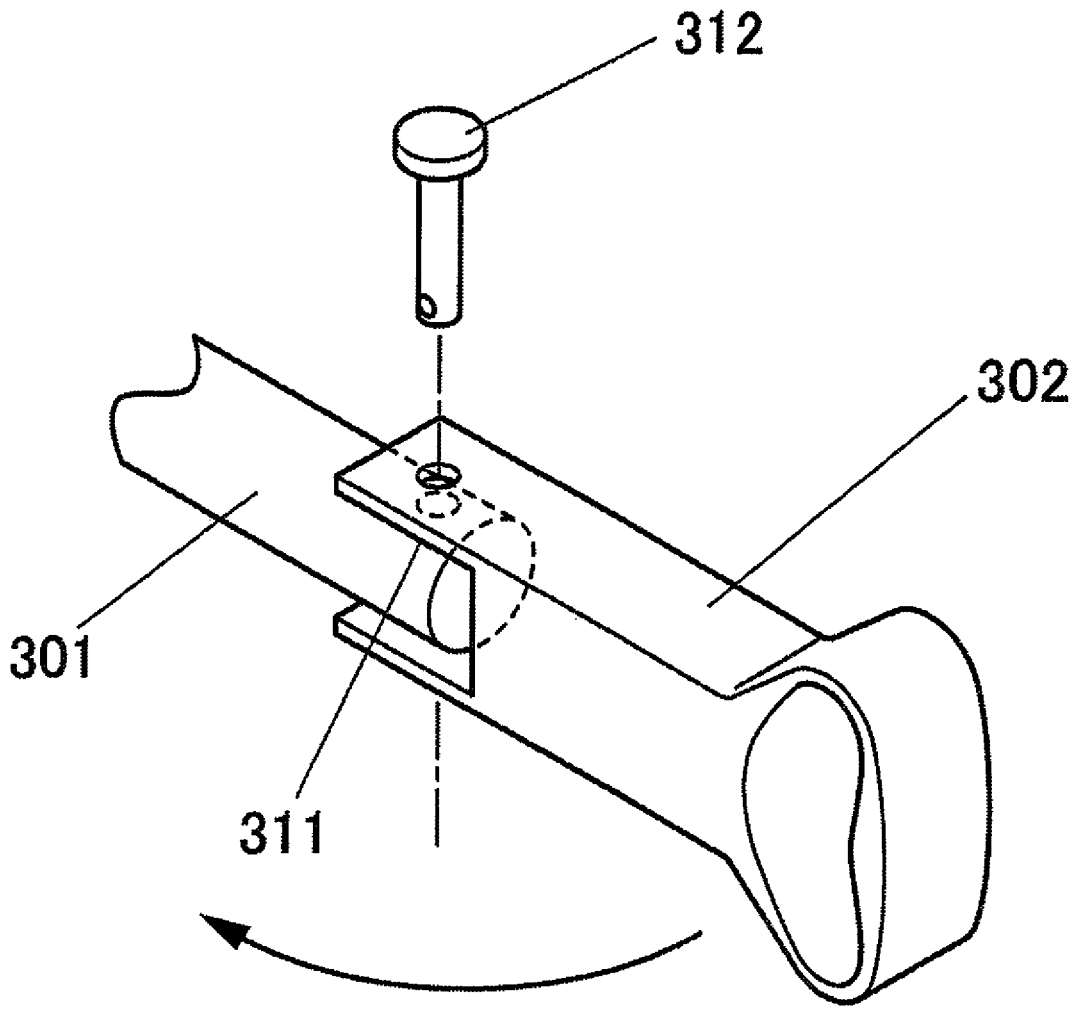
FIG. 18 is a perspective view showing a modification of the pin operating rod.

The construction of the pin operating rod 300 that is foldable is not limited to the one mentioned above. For instance, it would be also acceptable to adapt the pin operating rod 300 such that the pin operating rod 300 is rotated by 90 degrees around the rod member 301 and the rod operating member 302 is swung around the ring pin 310 horizontally when the pin operating rod 300 is to be folded. Moreover, it would be also acceptable to adapt the pin operating rod 300 such that one end of the rod member 301 is inserted in the rod operating member 302 so as to be nipped between forked ends of the rod operating member 302 as shown in FIG. 18. For example, a groove 311 is formed in the rod operating member 302, the rod member 301 is inserted in the groove 311, and the rod member 301 and the rod operating member 302 are linked with a pin 312.

As described above, according to the first and the second embodiments of the present invention, the counterweight is mounted by operating the rod member to move the pin member. Accordingly, the work space need not be secured in the center part of the counterweight, and a decrease in weight of the counterweight can be suppressed.

While the example of mounting counterweight 10 to the crane has been explained in the first and second embodiments above-mentioned, the installation device of a counterweight in accordance with the present invention can be adopted also to other construction machines. Namely, as long as the features and functions of the present invention are realized, the counterweight device according to the present invention is not limited to the examples presented in the first and second embodiments.

The above-described embodiments are examples, and various modifications can be made without departing from the scope of the invention.

What is claimed is:

1. A counterweight installation device, comprising:

a weight support unit provided on a rear end of a body frame of a construction machine;

a weight mounting unit disposed on a counterweight;

a pin member for mounting the counterweight adapted to move between a first position at which the weight mounting unit is mounted on the weight support unit and a second position at which the weight mounting unit is dismounted from the weight support unit; and a rod device, one end of which is linked with the pin member and an other end of which extends so as to project to an outside of the counterweight, adapted to move the pin member between the first position and the second position by operation at the other end thereof, a hydraulic cylinder swingably supported on the counterweight to move between one of a forward and a rearward position to engage the weight support unit to raise the weight mounting unit and the other of the forward position and the rearward position to disengage from the weight support unit, and a handle for moving the hydraulic cylinder between the forward and rearward positions provided at a rear side of the hydraulic cylinder, and a recess at an upper surface of the counterweight on a rear side of the hydraulic cylinder that provides access from behind the counter to the handle to move the hydraulic cylinder between the forward and rearward positions.

2. A counterweight installation device according to claim 1, wherein:

the hydraulic cylinder comprises a pair of hydraulic cylinders disposed along a direction of width of the body frame, and the pin member is movable into a gap between the pair of hydraulic cylinders.

3. A counterweight installation device according to claim 1, further comprising:

an engaging groove disposed in the weight support unit;

an engaging member disposed in the counterweight mounting unit; and a positioning device that regulates a position of the weight mounting unit relative to the weight support unit by engagement of the engaging groove with the engaging member.

4. A counterweight installation device, comprising:

a weight support unit provided on a rear end of a body frame of a construction machine;

a weight mounting unit disposed on a counterweight;

a pin member for mounting the counterweight adapted to move between a first position at which the weight mounting unit is mounted on the weight support unit and a second position at which the weight mounting unit is dismounted from the weight support unit; and a rod device, one end of which is linked with the pin member and an other end of which extends so as to project to an outside of the counterweight, adapted to move the pin member between the first position and the second position by operation that moves the other end thereof, wherein:

the rod device comprises a rod member linked to the pin member; and a rod operating member that moves alone the direction between the first position and the second position to position the rod member; and the rod device is configured such that rod operating member extends and contracts a length of the rod device between the one end and the other end.

5. A counterweight installation device according to claim 4, wherein:

the rod device is configured such that the rod operating member is foldable with respect to the rod member.

6. A counterweight installation device according to claim 5, wherein:

when the pin member is in the first position, the rod operating member is folded with respect to the rod member to contract the length of the rod device between the one end and the other end and when the pin member is in the second position, the rod operating member is disallowed to be folded with respect to the rod member.

7. A counterweight installation device according to claim 4, wherein:

the counterweight is provided with a concave part that extends in a direction of width of the body frame and through which the rod member passes, and a concave part that is provided on a side surface of the counterweight and that houses the rod operating member when the pin member is at the first position.

8. A counterweight installation device according to claim 4, wherein:

when the pin member is at the first position, the rod operating member functions as a retaining member for retaining the pin member.

9. A counterweight installation device, comprising:

a weight support unit provided on a rear end of a body frame of a construction machine;

a weight mounting unit disposed on a counterweight;

a pin member for mounting the counterweight adapted to move between a first position at which the weight mounting unit is mounted on the weight support unit and a second position at which the weight mounting unit is dismounted from the weight support unit; and a rod device, one end of which is linked with the pin member and an other end of which extends so as to project to an outside of the counterweight, adapted to move the pin member between the first position and the second position by operation at the other end thereof, wherein:

a groove is formed in the rod member along a longitudinal direction thereof;

the rod device is constituted by inserting the rod operating member in the groove of the rod member, and linking the rod member with the rod operating member through a pin;

the rod device comprises a rod member linked to the pin member; and a rod operating member that operates the rod member; and the rod device is configured such that the rod operating member is foldable with respect to the rod member.

10. A counterweight installation device according to claim 9, wherein:

the rod device further comprises a ring pin that fixes the rod operating member to the rod member in a folded state.

* * * * *